US005260183A

United States Patent [19]

Ishiguro et al.

[11] Patent Number: 5,260,183

[45] Date of Patent: Nov. 9, 1993

[54] SILVER HALIDE PHOTOGRAPHIC MATERIAL

[75] Inventors: Shoji Ishiguro; Tadashi Ikeda, both of Kanagawa, Japan

[73] Assignee: Fuji Photo Film Co., Ltd., Kanagawa, Japan

[21] Appl. No.: 827,062

[22] Filed: Jan. 28, 1992

[30] Foreign Application Priority Data

Feb. 7, 1991 [JP] Japan ..... 3-036632

[51] Int. Cl.[5] ..... G03C 1/005; G03C 1/494

[52] U.S. Cl. ..... 430/567; 430/573; 430/587; 430/583; 430/609; 430/615; 430/572; 430/575

[58] Field of Search ..... 430/573, 587, 583, 609, 430/615, 567, 572, 575

[56] References Cited

U.S. PATENT DOCUMENTS

| | | | |
|---|---|---|---|
| 3,695,888 | 10/1972 | Hiller | 430/573 |
| 3,809,561 | 5/1974 | Ulbing | 430/573 |
| 4,026,707 | 5/1977 | Obikawa | 430/615 |
| 4,400,463 | 8/1983 | Maskasky | 430/567 |
| 4,414,306 | 11/1983 | Wey et al. | 430/567 |
| 4,536,473 | 8/1985 | Mihara | 430/573 |
| 4,582,786 | 4/1986 | Ikeda | 430/615 |
| 4,837,140 | 6/1989 | Ikeda | 430/583 |
| 4,839,270 | 6/1989 | Kojima | 430/583 |
| 4,935,337 | 6/1990 | Kuwashima | 430/587 |
| 4,965,182 | 10/1990 | Mihara | 430/615 |
| 4,983,508 | 1/1991 | Ishiguro et al. | 430/567 |

FOREIGN PATENT DOCUMENTS

| | | | |
|---|---|---|---|
| 3340571 | 5/1984 | Fed. Rep. of Germany | 430/609 |
| 0141027 | 12/1978 | Japan | 430/615 |
| 0054936 | 4/1982 | Japan | 430/587 |

*Primary Examiner*—Charles L. Bowers, Jr.

*Assistant Examiner*—Geraldine Letscher

*Attorney, Agent, or Firm*—Sughrue, Mion, Zinn, Macpeak & Seas

[57] ABSTRACT

A novel silver halide photographic material comprising at least one silver halide emulsion layer on a support is provided, characterized in that said emulsion layer comprises (i) silver halide grains which are at least 80 mol % silver chloride, (ii) at least one thiocyanate, (iii) at least one cyanine dye represented by general formula (I) and (iv) at least one compound represented by general formula (II), (III) or (IV):

(I)

(II)

(III)

(IV)

4 Claims, 6 Drawing Sheets

SILVER HALIDE PHOTOGRAPHIC MATERIAL

FIELD OF THE INVENTION

The present invention relates to a spectrally sensitized photographic silver halide emulsion. More particularly, the present invention relates to a spectrally sensitized high silver chloride content silver halide photographic material which is sensitive particularly to visible light and infrared radiation.

BACKGROUND OF THE INVENTION

In recent times, it has been eagerly desired in the photographic industry to shorten access time. Thus, there has been a keen desire to develop a silver halide photographic material suitable for ultrarapid processing, particularly a silver halide emulsion for use in the preparation thereof.

Silver halides comprising silver bromide as the main component which have heretofore been mainly used are fundamentally unfavorable for rapid processing because the bromine ions released during development are development inhibiting. For ultrarapid processing, silver halides comprising silver chloride as the main component may be preferably used.

When the silver chloride content of the silver halide grains is increased, the water solubility of the grains is also increased, making it possible to develop and fix the light-sensitive material in a shorter period of time. Thus, a silver halide emulsion suitable for ultrarapid processing can be obtained.

However, silver halide grains having a high silver chloride content (hereinafter referred to as "high silver chloride content grains") are disadvantageous in that they normally can easily become 100 plane cubic grains which can be fast developed but can easily be fogged and exhibit a low sensitivity.

Further, the inherent absorption range of high silver chloride content grains is in a short wavelength range. In order to make the high silver chloride content grains absorb visible light and/or infrared radiation in a longer wavelength range and render the high silver chloride content grains sensitive also to the wavelength range, it is necessary to subject the high silver chloride content grains to spectral sensitization. However, even if spectrally sensitized with a compound commonly applied to emulsions comprising silver bromide as a main component, a silver chloride emulsion having a silver chloride content of 80 mol % or more normally exhibits poor absorption and remarkably poor spectral sensitizability. This is even more true when the silver chloride content is 95 mol % or more. Such compounds for spectral sensitization are normally methine dyes. In particular, cyanine dyes which provide emulsions having silver bromide as a main component with an extremely good spectral sensitizability have such a tendency. Among cyanine dyes, many compounds which form J-aggregates and provide so-called J-band sensitization in an emulsion comprising silver bromide as a main component to give a high spectral sensitivity have been recognized. This J-band sensitization is an essential technique for giving a high trapping of light of a specific wavelength (such as laser light) or for providing a light-sensitive material or color light-sensitive material sensitized to light of a specific wavelength range. However, compared to grains comprising silver bromide as a main component, high silver chloride content grains ca barely form such J aggregates and thus cannot benefit from J-band sensitization.

Moreover, high silver chloride content grains can easily become cubic grains, and an elaborate technique is needed to obtain grains other than cubic grains such as regular grain, e.g., octahedron having 111 plane and tetrdecahedron and tabular grains from high silver chloride content grains. In order to obtain such grains, modifiers for the growth of high silver chloride content grains are often used. For example, F. H. Claes et al teach in "Crystal Habit Modification of AgCl by Impurities Determining the Solvation", *The Journal of Photographic Science*, Vol. 21, pp. 39–50, 1973, and "Influence of the Habit of Silver Halide Crystals on the Absorption Spectra of Adsorbed Sensitizing", *The Journal of Photographic Science*, Vol. 21, pp. 85–92, 1973, the formation of silver chloride crystals having 110 plane and 111 plane with various grain growth modifiers such as purine derivatives and thiourea derivatives. F. H. Claes et al reported that J-band can be easily developed on a 100 plane and M- and D-band can be easily developed on 110 and 111 planes. JP-B-55-42737 (the term "JP-B" as used herein means an "examined Japanese patent publication") discloses the formation of dodecahedral silver chloride grains having a 110 plane with imidazole derivatives. U.S. Pat. No. 4,400,463 discloses the formation of tabular silver chloride grains having 111 plane as a main plane with adenine and poly(3-thiapentylmethacrylate)-co-acrylate-co-sodium 2-methacryloyloxyethyl-1-sulfonate. U.S. Pat. No. 4,801,523 discloses the formation of octahedral and tabular silver chloride grains having 111 plane with adenine derivatives. JP-A-62-218959, JP-A-63-213836, and JP-A-63-218938 (the term "JP-A" as used herein means an "unexamined published Japanese patent application") disclose the formation of tabular silver chloride grains with thiourea derivatives. U.S. Pat. No. 4,225,666 discloses the formation of octahedral silver chloride grains having a 111 plane with merocyanine dyes. However, the silver chloride grains formed with such grain growth modifiers have a small amount of modifiers left on the surface thereof, and these modifiers strongly inhibit the adsorption of the spectral sensitizer which must be used to provide spectral sensitization, providing only a low spectral sensitivity or making the grains extremely foggable. Further, if a specific merocyanine dye is used as modifier, it causes spectral sensitization, providing sensitization in an unnecessary wavelength range and inhibiting sensitization in the desired wavelength range with a spectral sensitizing dye. The various disadvantages disable the silver halide grains used for silver halide light-sensitive materials.

One of the inventors discloses in JP-A-2-000032 that octahedral and tabular silver chloride grains having a 111 plane free from these disadvantages can be formed with bispyridinium salt derivatives as silver chloride grain growth modifiers. These modifiers can be easily removed after the formation of the grains. Therefore, the above cited invention is an excellent approach by which octahedral and tabular silver chloride grains having a 111 plane and having no modifiers left thereon can be obtained. Unlike cubic grains having a 100 plane, these grains can be easily subjected to chemical sensitization such as gold and sulfur sensitization without being fogged to provide a high sensitivity silver chloride emulsion. However, as taught by F. H. Claes in the above cited references, even if no silver chloride grain growth modifiers remain, high silver chloride content grains having a 111 plane barely form J-aggregates and exhibit a remarkably poor adsorption of cyanine dyes which are extremely important for the production of silver halide light-sensitive materials as compared to silver halide grains comprising silver bromide as a main component and cubic silver chloride grains having a 100 plane, imposing great restrtictions on spectral sensitization. Therefore, if an approach can be found which enables sufficient J-band spectral sensitization in a high silver chloride content emulsion having a 111 plane, a silver halide photographic emulsion and a silver halide light-sensitive material are obtained which exhibit a higher spectral sensitivity in a desired wavelength range and which can be subjected to ultrarapid processing.

SUMMARY OF THE INVENTION

It is therefore an object of the present invention to provide a high silver chloride content emulsion having a high spectral sensitivity, particularly a high silver chloride emulsion having a high spectral sensitivity attained by J-band sensitization.

It is another object of the present invention to provide a high sensitivity high silver chloride content emulsion having a high 111 plane proportion which has been subjected to J-band spectral sensitization.

It is a further object of the present invention to provide a high sensitivity high silver chloride content emulsion which can be subjected to ultrarapid processing and has been subjected to J-band spectral sensitization and a silver halide light-sensitive material prepared therefrom.

These and other objects of the present invention will become more apparent from the following detailed description and examples.

These objects of the present invention are accomplished with a silver halide photographic material comprising at least one silver halide emulsion layer on a support, characterized in that the emulsion layer comprises (i) silver halide grains which are at least 80 mol % silver chloride, (ii) at least one thiocyanate, (iii) at least one cyanine dye represented by general formula (I) and (iv) at least one compound represented by general formula (II), (III) or (IV):

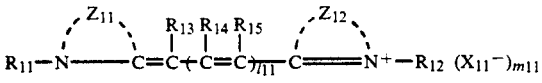

(I)

wherein $Z_{11}$ and $Z_{12}$ may be the same or different and each represents a 5- or 6-membered nitrogen-containing heterocyclic nucleus-forming atom group ; $l_{11}$ represents an integer 0, 1 or 2; $R_{11}$ and $R_{12}$ may be the same or different and each represents an alkyl or alkenyl group which may be substituted; $R_{13}$ and $R_{15}$ each represents a hydrogen atom; $R_{13}$ may be connected to $R_{11}$ to form a 5- or 6-membered ring; $R_{15}$ may be connected to $R_{12}$ to form a 5- or 6-membered ring; $R_{14}$ represents a hydrogen atom or a lower alkyl group which may be substituted; $X_{11}$ represents an ion required to neutralize the electrical charge of the dye; and $m_{11}$ represents an integer 0 or 1, with the provisos that when $l_{11}$ is 2, $R_{15}$ on the third carbon atom of the methine chain may represent a lower alkyl group which may be substituted, that when $l_{11}$ is 2, the $R_{14}$ groups which are different from each other may be connected to each other to form a 6-membered carbon ring, and that when the compound is an intramolecular salt, $m_{11}$ is 0;

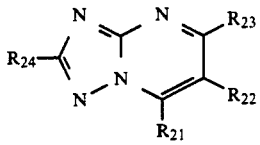

(II)

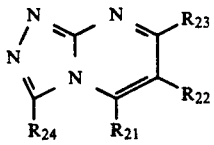

(III)

wherein $R_{21}$, $R_{22}$, $R_{23}$ and $R_{24}$ may be the same or different and each represents a hydrogen atom, an alkyl group which may be substituted, an aryl group which may be substituted, an amino group which may be substituted, a hydroxyl group, an alkoxy group, an alkylthio group, a carbamoyl group which may be substituted, a halogen atom, a cyano group, a carboxyl group, a alkoxycarbonyl group or a heterocyclic group; and $R_{21}$ and $R_{22}$ or $R_{22}$ and $R_{23}$ may be connected to each other to form a 5- or 6-membered ring, with the proviso that at least one of $R_{21}$ and $R_{23}$ represents a hydroxyl group;

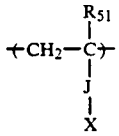

(IV)

wherein $R_{51}$ represents a hydrogen atom or an alkyl group; X represents a monovalent group obtained by removing a hydrogen atom from a compound represented by general formula (II) or (III); and J represents a divalent linking group.

BRIEF DESCRIPTION OF THE DRAWINGS

These and other objects and advantages and further description will now be discussed in connection with the drawings in which.

DETAILED DESCRIPTION OF THE INVENTION

Figure 1:
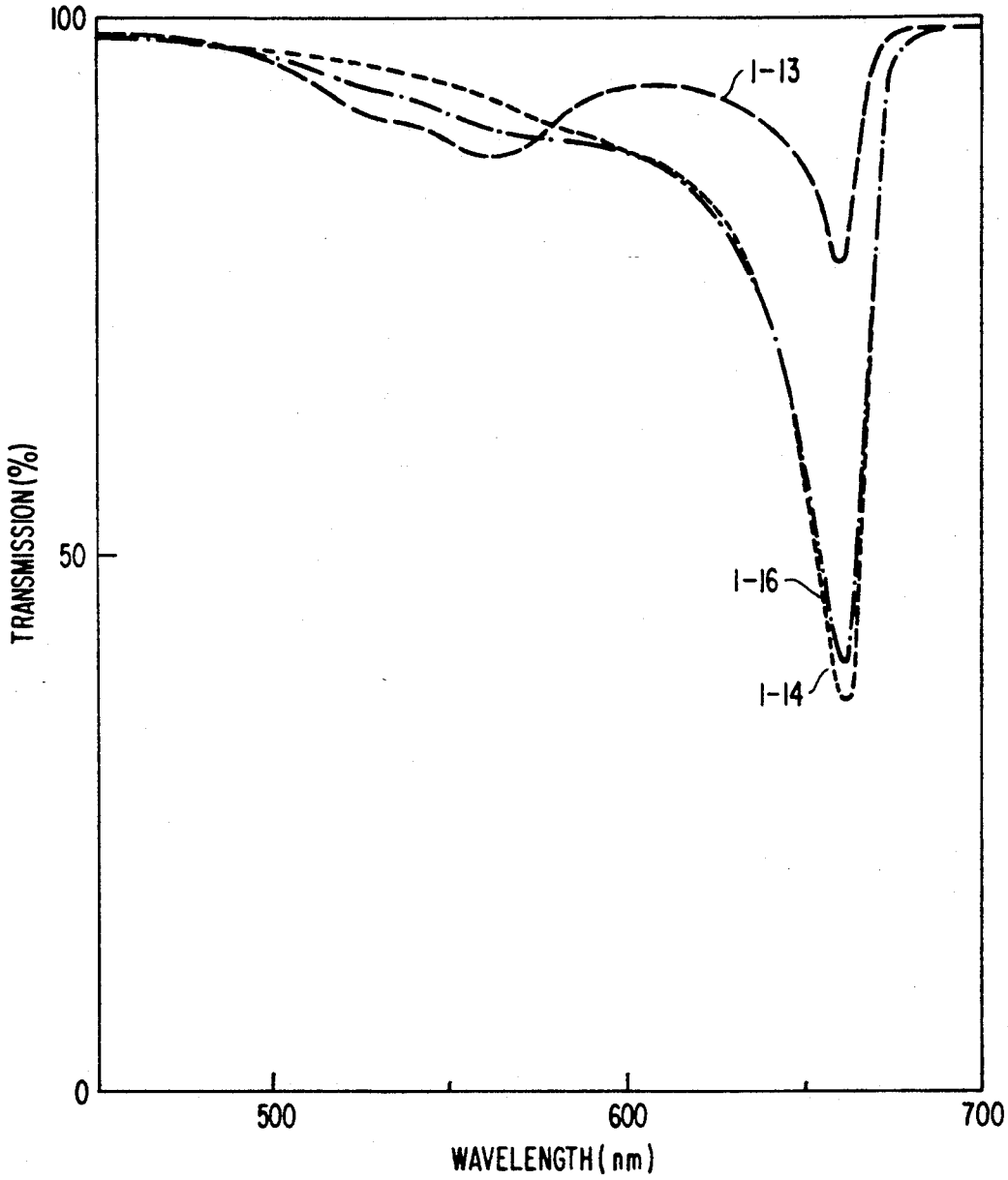
FIG. 1 is a graph illustrating the transmission absorption spectrum of Specimens 1-13 (broken line), 1-14 (dotted line) and 1-16 (chain line) of Example 1.

The present invention will be further described hereinafter.

In the general formula (I), $Z_{11}$ and $Z_{12}$ may be the same or different and each represents a 5- or 6-membered nitrogen-containing heterocyclic nucleus-forming atom group, and $l_{11}$ represents an integer 0, 1 or 2. Preferred examples of the heterocyclic nucleus represented by $Z_{11}$ and $Z_{12}$ which may be the same or different, if $l_{11}$ is 0 or 1, include thiazole, benzothiazole, naphthothiazole, dihydronaphthothiazole, selenazole, benzoselenazole, naphthoselenazole, dihydronaphthoselenazole, oxazole, benzoxazole, naphthoxazole, benzimidazole, naphthoimidazole, pyridine, quinoline, imidazo[4,5-b]quinoxaline, and 3,3-dialkylindolenine. If $l_{11}$ is 2, preferred examples of $Z_{11}$ and $Z_{12}$ which may be the same or different include benzothiazole, benzoselenazole, benzoxazole, naphthoxazole, benzimidazole, and naphthoimidazole.

The nitrogen-containing heterocyclic nucleus represented by $Z_{11}$ or $Z_{12}$ may contain one or more substituents. Preferred examples of substituents for the nitrogen-containing heterocyclic nucleus of $Z_{11}$ or $Z_{12}$ which represents nucleus other than benzimidazole and naphthoimidazole include a lower alkyl group (e.g., a lower alkyl group which may be branched or further contain substituents such as a hydroxyl group, a halogen atom, an aryl group, an aryloxy group, an arylthio group, a carboxyl group, an alkoxy group, an alkylthio group and an alkoxycarbonyl group, more preferably an alkyl group containing 8 or less carbon atoms, such as methyl, ethyl, butyl, chloroethyl, 2,2,3,3-tetrafluoropropyl, hydroxyl, benzyl, carboxypropyl, methoxyethyl, ethylthioethyl and ethoxycarbonylethyl), a lower alkoxy group (e.g., a lower alkoxy group which may contain substituents such as those described with reference to the above mentioned lower alkyl group, more preferably an alkoxy group containing 8 or less carbon atoms, such as methoxy, ethoxy, pentyloxy, ethoxymethoxy, methylthioethoxy, phenoxyethoxy, hydroxyethoxy and chloropropoxy), a hydroxyl group, a halogen atom, an aryl group (e.g., phenyl, tolyl, anisyl, chlorophenyl, carboxyphenyl), an aryloxy group (e.g., tolyloxy, anisyloxy, phenoxy, chlorophenoxy), an arylthio group (e.g., tolylthio, chlorophenylthio, phenylthio), a lower alkylthio group (e.g., lower alkylthio group which may be further substituted by substituents such as those described with reference to the above mentioned lower alkyl group, more preferably an alkylthio group containing 8 or less carbon atoms, such as methylthio, ethylthio, hydroxyethylthio, carboxyethylthio, chloroethylthio, benzylthio), an acylamino group (more preferably an acylamino group containing 8 or less carbon atoms, such as acetylamino, benzoylamino, methanesulfonylamino, benzenesulfonylamino), a carboxyl group, a lower alkoxycarbonyl group (more preferably an alkoxycarbonyl group containing 6 or less carbon atoms, such as ethoxycarbonyl and butoxycarbonyl), a perfluoroalkyl group (more preferably a perfluoroalkyl group containing 5 or less carbon atoms, such as trifluoromethyl and difluoromethyl), and an acyl group (more preferably an acyl group containing 8 or less carbon atoms, such as acetyl, propionyl, benzoyl and benzenesulfonyl). Preferred examples of substituents for the nitrogen-containing heterocyclic nucleus of $Z_{11}$ or $Z_{12}$ which represents benzimidazole or naphthoimidazole if $l_{11}$ is 0 or 1, include a halogen atom, a cyano group, a carboxyl group, a lower alkoxycarbonyl group (more preferably an alkoxycarbonyl group containing 6 or less carbon atoms, such as ethoxycarbonyl and butoxycarbonyl), a perfluoroalkyl group (more preferably a perfluoroalkyl group containing 5 or less carbon atoms, such as trifluoromethyl and difluoromethyl), and an acyl group (more preferably an acyl group containing 8 or less carbon atoms, such as acetyl, propionyl, benzoyl, and benzenesulfonyl). Preferred examples of substituents for the nitrogen-containing heterocyclic nucleus of $Z_{11}$ or $Z_{12}$ which represents benzimidazole or naphthoimidazole if $l_{11}$ is 2 include a halogen atom, a cyano group, a carboxyl group, and a lower alkoxycarbonyl group containing 5 or less carbon atoms.

Specific examples of the nitrogen-containing heterocyclic nucleus represented by $Z_{11}$ or $Z_{12}$ include benzothiazole, 5-methylbenzothiazole, 6-methylbenzothiazole, 5-ethylbenzothiazole, 5,6-dimethylbenzothiazole, 5-methoxybenzothiazole, 6-methoxybenzothiazole, 5-butoxybenzothiazole, 5,6-dimethoxybenzothiazole, 5-methoxy-6-methylbenzothiazole, 5 chlorobenzothiazole, 5-chloro-6-methylbenzothiazole, 5-phenylbenzothiazole, 5-acetylaminobenzothiazole, 6-propionylaminobenzothiazole, 5-hydroxybenzothiazole, 5-hydroxy-6-methylbenzothiazole, 5-ethoxycarbonylbenzothiazole, 5-carboxybenzothiazole, naphtho[1,2-d]thiazole, naphtho[2,1-d]thiazole, 5-methylnaphtho[1,2-d]thiazole, 8-methoxynaphtho[1,2-d]thiazole, 8,9-dihydronaphthothiazole, 3,3-diethylindolenine, 3,3-dipropylindolenine, 3,3-dimethylindolenine, 3,3,5-trimethylindolenine, benzoselenazole, 5-methylbenzoselenazole, 6-methylbenzoselenazole, 5-methoxybenzoselenazole, 6-methoxybenzoselenazole, 5-chlorobenzoselenazole, 5,6-dimethylbenzoselenazole, 5-hydroxybenzoselenazole, 5-hydroxy-6-methylbenzoselenazole, 5,6-dimethoxybenzoselenazole, 5-ethoxycarbonylbenzoselenazole, naphtho[1,2-d]selenazole, naphtho[2,1-d]selenazole, benzoxazole, 5-hydroxybenzoxazole, 5-methoxybenzoxazole, 5-phenylbenzoxazole, 5-phenethylbenzoxazole, 5-phenoxybenzoxazole, 5-chlorobenzoxazole, 5-chloro-6-methylbenzoxazole, 5-phenylthiobenzoxazole, 6-ethoxy-5-hydroxybenzoxazole, 6-methoxybenzoxazole, naphtho[1,2-d]oxazole, naphtho[2,1-d]oxazole, naphtho[2,3-d]oxazole, 1-ethyl-5-cyanobenzimidazole, 1-ethyl-5-chlorobenzimidazole, 1-ethyl-5,6-dichlorobenzimidazole, 1-ethyl-6-chloro-5-cyanobenzimidazole, 1-ethyl-6-chloro-5-trifluoromethylbenzimidazole, 1-ethyl-5,6-dichlorobenzimidazole, 1-ethyl-6-fluoro-5-cyanobenzimidazole, 1-propyl-5-butoxycarbonylbenzimidazole, 1-benzyl-5-methylsulfonylbenzimidazole, 1-allyl-5-chloro-6-acetylbenzimidazole, 1-ethylnaphtho-[1,2-d]imidazole, 1-ethylnaphtho[2,3-d]imidazole, 1-ethyl-6-chloronaphtho[2,3-d]imidazole, 2-quinoline, 4-quinoline, 8-fluoro-4-quinoline, 6-methyl-2-quinoline, 6-hydroxy-2-quinoline, and 6-methoxy-2-quinoline.

$R_{11}$ and $R_{12}$ may be the same or different and each represents an alkyl or alkenyl group containing 10 or less carbon atoms which may be substituted. Preferred examples of the substituents for the alkyl group and alkenyl group include a sulfo group, a carboxyl group, a halogen atom, a hydroxyl group, an alkoxy group containing 6 or less carbon atoms, an aryl group containing 8 or less carbon atoms (e.g., phenyl, tolyl, sulfophenyl, carboxyphenyl), a heterocyclic group (e.g., furyl, chenyl), an aryloxy group containing 8 or less carbon atoms which may be substituted (e.g., chlorophenoxy, phenoxy, sulfophenoxy, hydroxyphenoxy), an acyl group containing 8 or less carbon atoms (e.g., benzenesulfonyl, methanesulfonyl, acetyl, propionyl), an alkoxycarbonyl group containing 6 or less carbon atoms (e.g., ethoxycarbonyl, butoxycarbonyl), a cyano group, an alkylthio group containing 6 or less carbon atoms (e.g., methylthio, ethylthio), an arylthio group containing 8 or less carbon atoms which may be substituted (e.g., phenylthio, tolylthio), a carbamoyl group containing 8 or less carbon atoms which may be substituted (e.g., carbamoyl, N-ethylcarbamoyl), and an acylamino group containing 8 or less carbon atoms (e.g., acetylamino, methanesulfonylamino). There may be one or more such substituents to $R_{11}$ and $R_{12}$.

Specific examples of the group represented by $R_{11}$ or $R_{12}$ include a methyl group, an ethyl group, a propyl group, an allyl group, a pentyl group, a hexyl group, a methoxyethyl group, an ethoxyethyl group, a phenethyl group, a tolylethyl group, a sulfophenethyl group, a 2,2,2-trifluoroethyl group, a 2,2,3,3-tetrafluoropropyl group, a carbamoylethyl group, a hydroxyethyl group, a 2-(2-hydroxyethoxy)ethyl group, a carboxymethyl group, a carboxyethyl group, an ethoxycarbonylmethyl group, a sulfoethyl group, a 2-chloro-3-sulfopropyl group, a 3-sulfopropyl group, a 2-hydroxy-3-sulfopropyl group, a 3-sulfobutyl group, a 4-sulfobutyl group, a 2-(2,3-dihydroxypropyloxy)ethyl group, and a 2-[2-(3-sulfopropyloxy)ethoxy]ethyl group.

$R_{13}$ and $R_{15}$ each represents a hydrogen atom. $R_{13}$ and $R_{11}$, and $R_{15}$ and $R_{12}$ may be connected to each other to form a 5- or 6-membered ring. Further, if $l_{11}$ is 2, $R_{15}$ on the third carbon atom of the methine chain may also represent a lower alkyl group (lower alkyl group which may be substituted, e.g., methyl, ethyl, propyl, methoxyethyl, benzyl, phenethyl).

$R_{14}$ represents a hydrogen atom or a lower alkyl group (a lower alkyl group which may be substituted, e.g., methyl, ethyl, propyl, methoxyethyl, phenethyl, preferably an alkyl group containing 5 or less carbon atoms). Moreover, if $l_{11}$ is 2, the two $R_{14}$ groups may be connected to each other to form a 6-membered carbon ring.

$X_{11}$ represents an ion required to neutralize the electrical charge of the dye.

The suffix $m_{11}$ represents an integer 0 or 1. If the compound represented by general formula (I) is an intramolecular salt, $m_{11}$ is 0.

In general formulae (II) and (III), $R_{21}$ and $R_{22}$ may be the same or different, and $R_{23}$ and $R_{24}$ may be the same or different. $R_{21}$, $R_{22}$, $R_{23}$, and $R_{24}$ each represents a hydrogen atom, a $C_{1-20}$ straight-chain, cyclic or branched substituted or unsubstituted alkyl group, a monocyclic or bicyclic substituted or unsubstituted aryl group, a substituted or unsubstituted amino group, a hydroxyl group, a $C_{1-20}$ alkoxy group, a $C_{1-6}$ alkylthio group, a carbamoyl group which may be substituted by an aliphatic or aromatic group, a halogen atom, a cyano group, a carboxyl group, a $C_{2-20}$ alkoxycarbonyl group, or a heterocyclic group containing a 5- or 6-membered ring which contains hetero atoms such as nitrogen, oxygen or sulfur. $R_{21}$ and $R_{22}$ or $R_{22}$ and $R_{23}$ may be connected to each other to form a 5- or 6-membered ring, with the proviso that at least one of $R_{21}$ and $R_{23}$ is a hydroxyl group.

$R_{51}$ represents a hydrogen atom or alkyl group. X represents a monovalent group obtained by removing one hydrogen atom from the compound represented by general formula (II) or (III) (e.g., compound obtained by removing one hydrogen atom from the portion of $R_{21}$, $R_{22}$, $R_{23}$ or $R_{24}$ in general formula (II) or (III)). J represents a divalent linking group.

Examples of the above mentioned unsubstituted alkyl groups include a methyl group, an ethyl group, an n-propyl group, an i-propyl group, a t-propyl group, an n-butyl group, a t-butyl group, a hexyl group, a cyclohexyl group, a cylopentylmethyl group, an octyl group, a dodecyl group, a tridecyl group, and a heptadecyl group. Examples of the substituents contained in the above mentioned substituted alkyl group include a monocyclic or bicyclic aryl group, a heterocyclic group, a halogen atom, a carboxyl group, a $C_{2-6}$ alkoxycarbonyl group, an alkoxy group containing 19 or less carbon atoms, and a hydroxyl group. Specific examples of the substituted alkyl group include a benzyl group, a phenethyl group, a chloromethyl group, a 2-chloroethyl group, a trifluoromethyl group, a carboxymethyl group, a 2-carboxyethyl group, a 2-(methoxycarbonyl-)ethyl group, an ethoxycarbonylmethyl group, a 2-methoxyethyl group, a hydroxymethyl group, and a 2-hydroxyethyl group.

Examples of the above mentioned unsubstituted aryl group include a phenyl group and a naphthyl group. Examples of the substituents contained in the above mentioned substituted aryl group include an alkyl group containing 4 or less carbon atoms, a halogen atom, a carboxyl group, a cyano group, an alkoxycarbonyl group containing 6 or less carbon atoms, a hydroxyl group, and an alkoxy group containing 6 or less carbon atoms. Specific examples of the substituted aryl group include a p-tolyl group, an m-tolyl group, a p-chlorophenyl group, a p-bromophenyl group, an o-chlorophenyl group, an m-cyanophenyl group, a p-carboxyphenyl group, an o-carboxyphenyl group, an o-(methoxycarbonyl)phenyl group, a p-hydroxyphenyl group, a p-methoxyphenyl group, and an m-ethoxyphenyl group.

Examples of the substituents contained in the above mentioned substituted amino group include an alkyl group (e.g., methyl, ethyl, butyl), and an acyl group (e.g., acetyl, propionyl, benzoyl, methylsulfonyl). Specific examples of such a substituted amino group include a dimethylamino group, a diethylamino group, a butylamino group, and an acetylamino group.

Specific examples of the above mentioned alkoxy group include a methoxy group, an ethoxy group, a butoxy group, and a heptadecyloxy group.

Specific examples of the above mentioned alkylthio group include a methylthio group, an ethylthio group, and a hexylthio group.

The above mentioned carbamoyl group may contain one or two of alkyl groups containing 20 or less carbon atoms and bicyclic or monocyclic aryl groups as substituents. Specific examples of such a substituted carbamoyl group include a methylcarbamoyl group, a dimethylcarbamoyl group, an ethylcarbamoyl group, and a phenylcarbamoyl group.

Specific examples of the above mentioned alkoxycarbonyl group include a methoxycarbonyl group, an ethoxycarbonyl group, and a butoxycarbonyl group.

Specific examples of the above mentioned halogen atom include a fluorine atom, a chlorine atom, and a bromine atom.

The above mentioned heterocyclic group may be monocyclic or may contain a bicyclic or tricyclic condensed ring. Specific examples of such a heterocyclic group include a furyl group, a pyridyl group, a 2-(3-methyl)benzothiazolyl group, and a 1-benzotriazolyl group.

In the above mentioned substituted alkyl group, if the substituent contained in the substituted alkyl group represented by $R_{24}$ is a heterocyclic group, it is preferably a substituent represented by general formula (V):

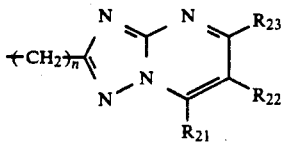

(V)

wherein $R_{21}$, $R_{22}$ and $R_{23}$ are as defined above; and n represents an integer 2, 3 or 4.

Preferred among the sensitizing dyes represented by general formula (I) are those wherein $Z_{11}$ and $Z_{12}$ both represent a heterocyclic nucleus-forming atom group such as benzothiazole, naphthothiazole, dihydronaphthothiazole, benzoselenazole, naphthoselenazole, dihydronaphtho-selenazole, benzoxazole, naphthoxazole, benzimidazole and naphthoimidazole [the heterocyclic nucleus represented by $Z_{11}$ or $Z_{12}$ may contain one or more substituents as mentioned above; particularly preferred examples of the substituents for the heterocyclic group wherein $Z_{11}$ and $Z_{12}$ each represents nucleus other than a benzimidazole nucleus or naphthoimidazole nucleus include a methyl group, an ethyl group, a propyl group, a methoxy group, an ethoxy group, an acetylamino group, a phenyl group, a tolyl group, and a chlorine atom; particularly preferred examples of the substituents for the heterocyclic group wherein $Z_{11}$ and $Z_{12}$ each represents benzimidazole nucleus or naphthoimidazole nucleus include a chlorine atom, a fluorine atom, a cyano group, a carboxyl group, and a lower alkoxycarbonyl group containing 5 or less carbon atoms], and $R_{13}$ and $R_{15}$ connected to a methine group adjacent to the heterocyclic nuclei each represents a hydrogen atom.

Other preferred examples of the sensitizing dyes include those represented by the general formula (I) wherein $l_{11}$ represents 1, and at least one of the heterocyclic groups represented by $Z_{11}$ and $Z_{12}$ represents a benzimidazole or naphthoimidazole nucleus-forming atom group, wherein $R_{14}$ represents a hydrogen atom, and the heterocyclic nuclei represented by $Z_{11}$ and $Z_{12}$ each represents a nucleus-forming atom group other than benzimidazole nucleus or naphthoimidazole nucleus, and wherein $R_{14}$ is an ethyl group, a propyl group, or a phenethyl group.

A technique for distributing silver thiocyanate on cubic silver chloride grains and tabular silver chloride grains having opposing parallel 111 main crystal planes is disclosed in JP-B-2-21572, and JP-A-59-162540. In that reference, an aqueous solution of silver nitrate and an aqueous solution of sodium thiocyanate are simultaneously added to host silver halide grains having a face-centered cubic rock salt structure in a double jet process so that silver thiocyanate is epitaxially precipitated on the edge or corner of the host grains to obtain a high inherent sensitivity. It is true that the precipitation of silver thiocyanate on high silver chloride content host grains can provide a higher sensitivity than the original host grains as taught by the above cited patents. However, this approach remarkably inhibits chemical sensitization, and the sensitivity obtained after chemical sensitization is not necessarily higher than that of the host grains. In particular, as demonstrated by the examples in the above cited patents, if a large amount of silver thiocyanate is used based on the host grains, the sensitivity obtained after chemical sensitization is lower than that of the host grains. Further, the above cited JP-A-59-162540 teaches in Example 6 an approach which comprises epitaxially precipitating silver thiocyanate on host cubic silver chloride grains, and then covering the core again by silver chloride as a shell. This teaching does not suggest that the precipitation of silver thiocyanate on silver chloride provides improvements in the adsorption of cyanine dye, particularly difficult J-band spectral sensitization. Moreover, in the above cited patent, the results of spectral sensitization are not for silver chloride grains but for host grains comprising silver bromide as a main component.

The inventors found that the combined use of a cyanine dye represented by general formula (I) and a thiocyanate on high silver content grains provides easy improvements in J-band spectral sensitization, which has been heretofore difficult. In particular, it was found that even high silver chloride content grains having a high 111 plane proportion, which has herefore rarely been subjected to J-band spectral sensitization, can be easily subjected to J-band spectral sensitization as in silver halide grains comprising silver bromide as main component. It was further found that the incorporation of at least one tetrazaindene compound represented by general formula (II), (III) or (IV) in the high silver chloride content emulsion can provide a high spectral sensitivity, and if optionally combined with chemical sensitization, can provide a high J-band spectral sensitization.

Specific examples of the sensitizing dye represented by general formula (I) will be set forth below, but the present invention should not be construed as being limited thereto:

I-1

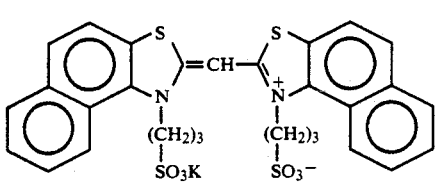

I-2

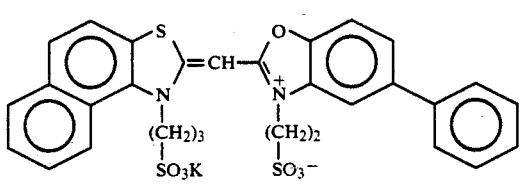

-continued
I-3
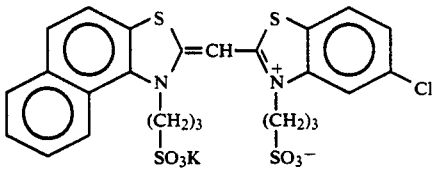
I-4
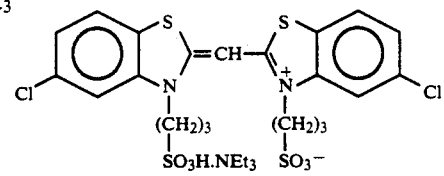
I-5
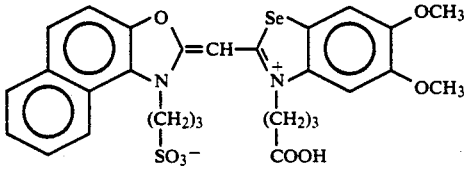
I-6
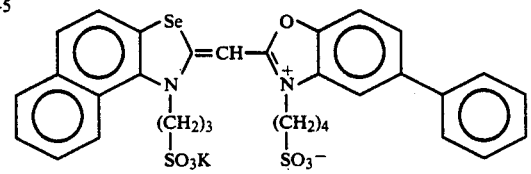
I-7
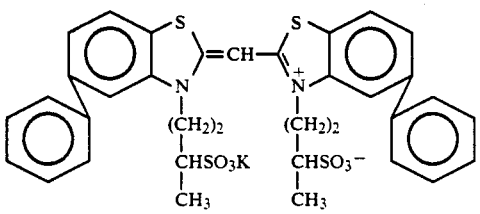
I-8
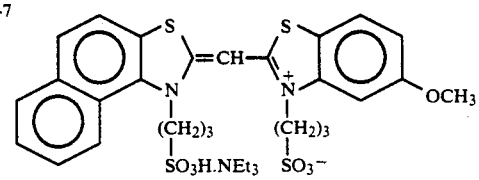
I-9
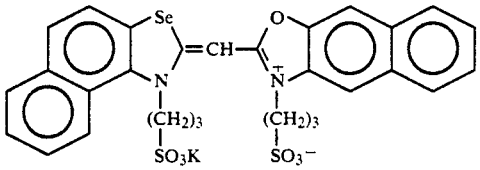
I-10
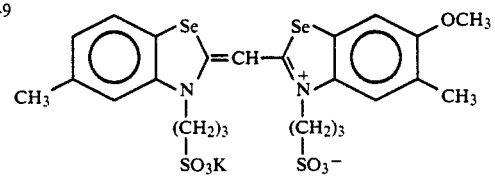
I-11
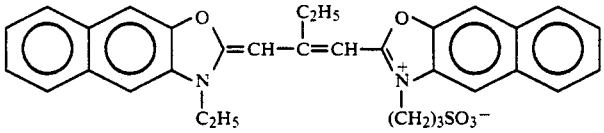
I-12
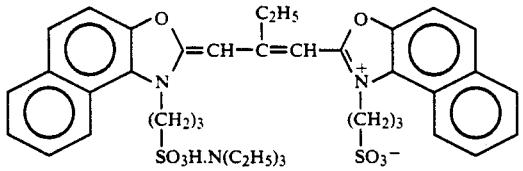
I-13
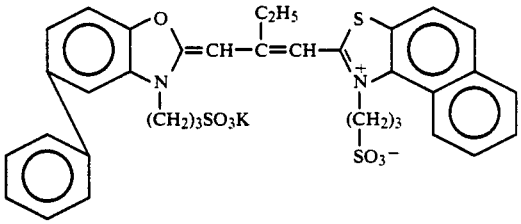
I-14
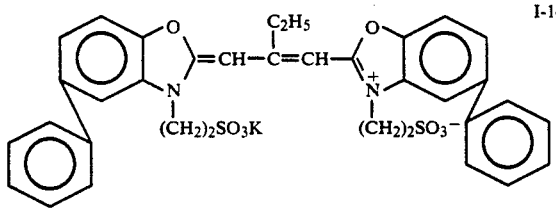
I-15
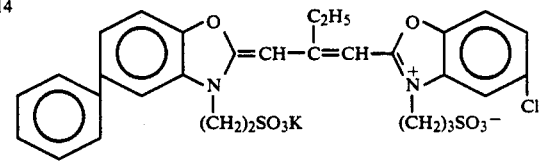
I-16
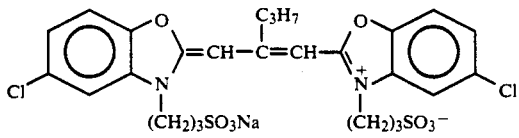
I-17
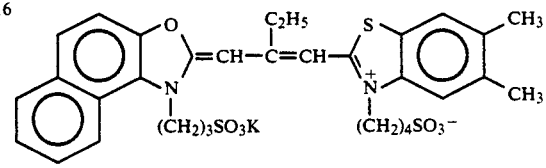

-continued
I-18
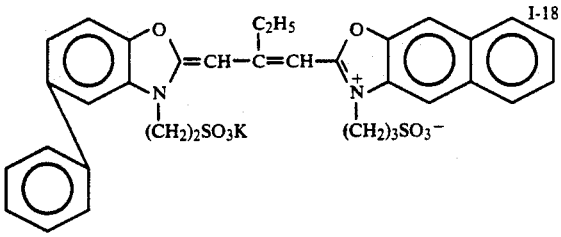
I-19
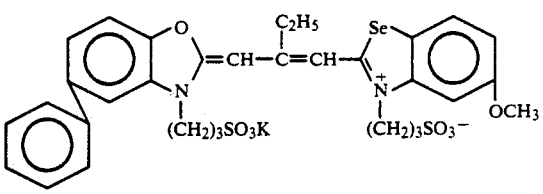
I-20
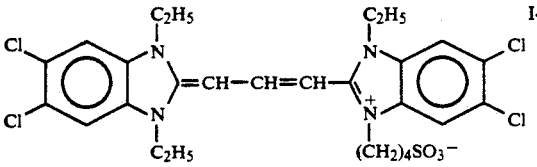
I-21
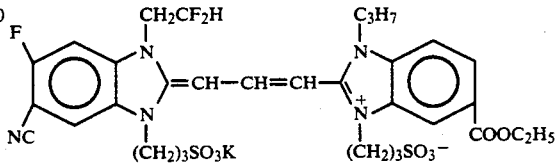
I-22
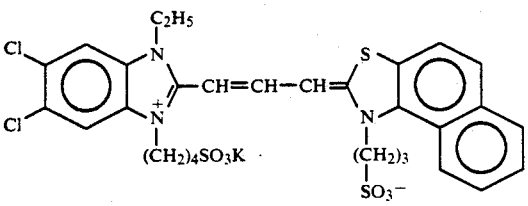
I-23
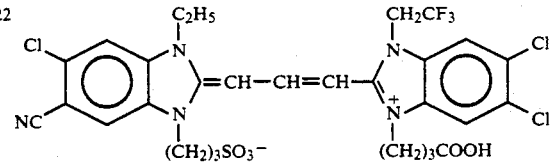
I-24
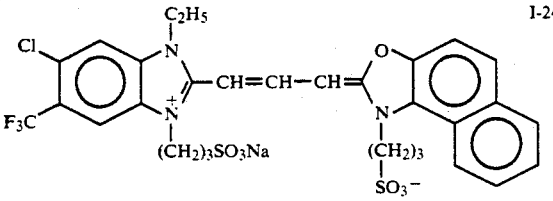
I-25
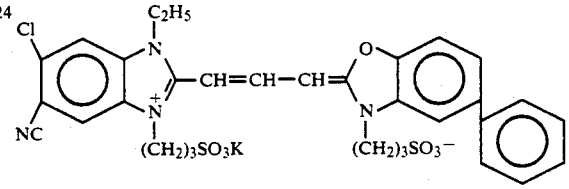
I-26
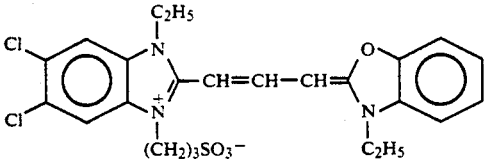
I-27
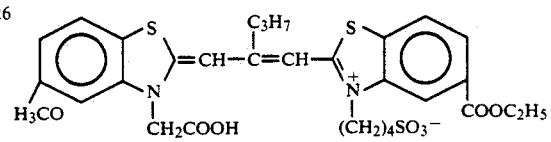
I-28
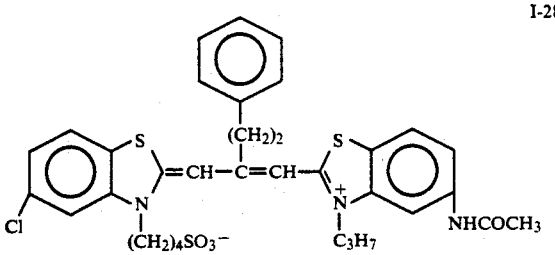
I-29
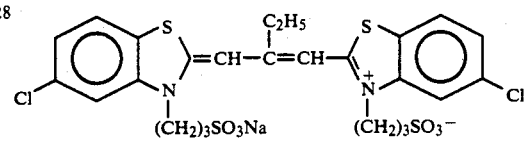
I-30
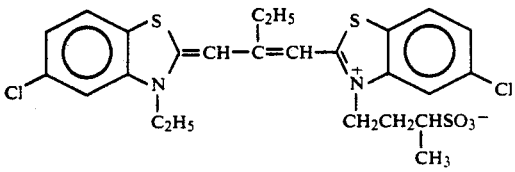
I-31
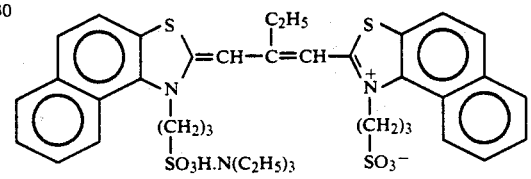

-continued
I-32
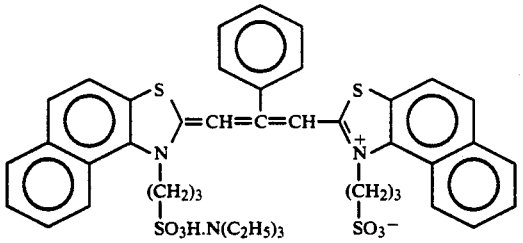
I-33
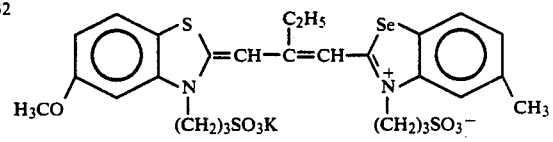
I-34
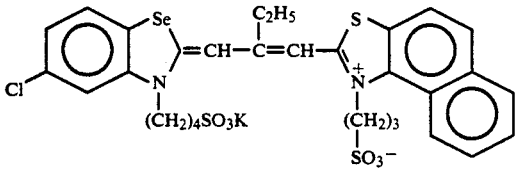
I-35
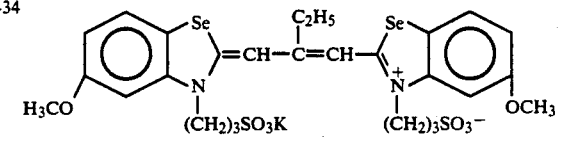
I-36
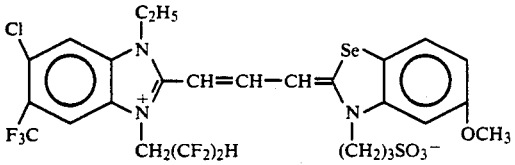
I-37
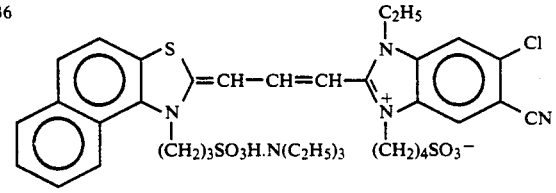
I-38
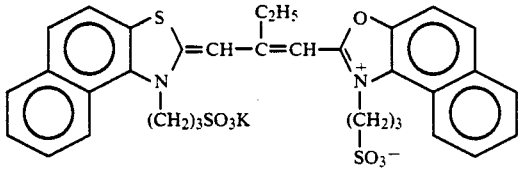
I-39
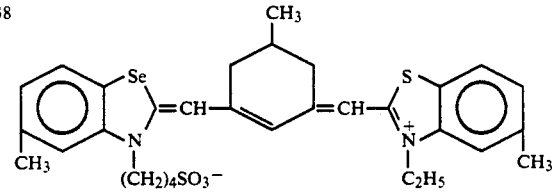
I-40
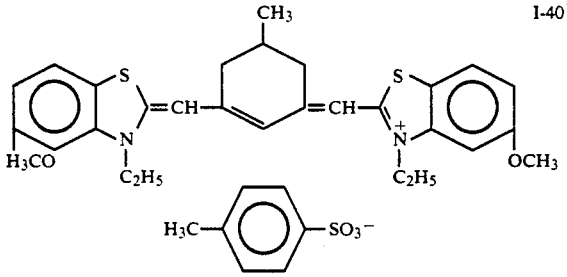
I-41
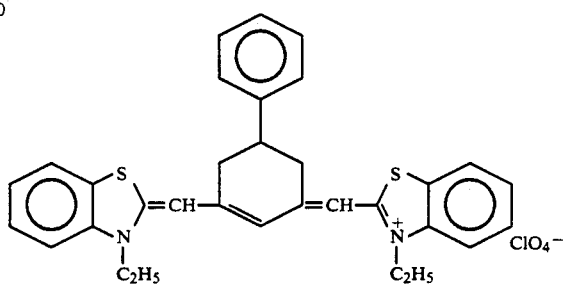
I-42
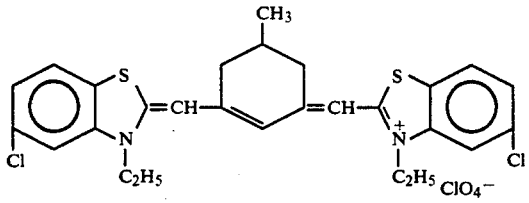
I-43
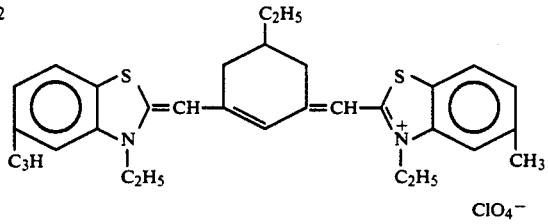
I-44
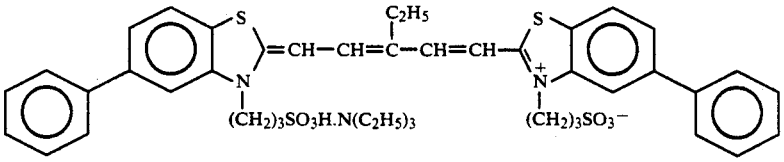

-continued

I-45

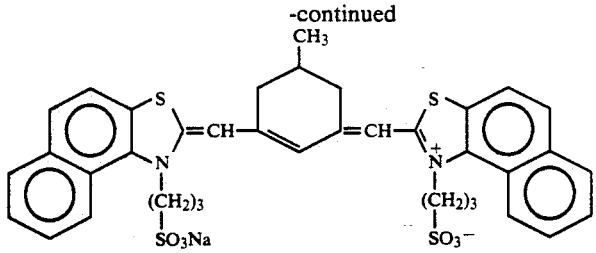

I-46

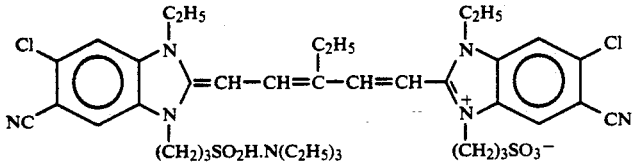

I-47

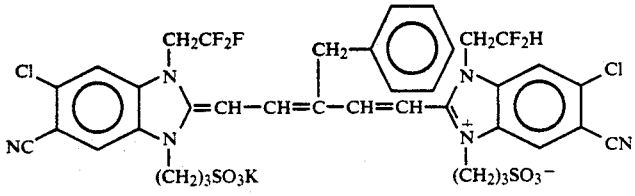

I-48

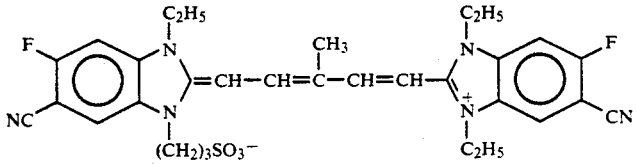

I-49

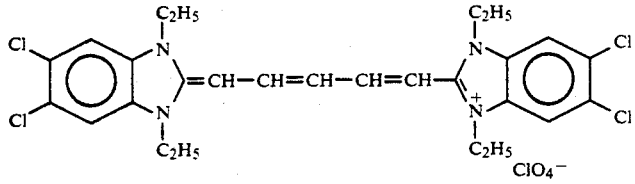

I-50

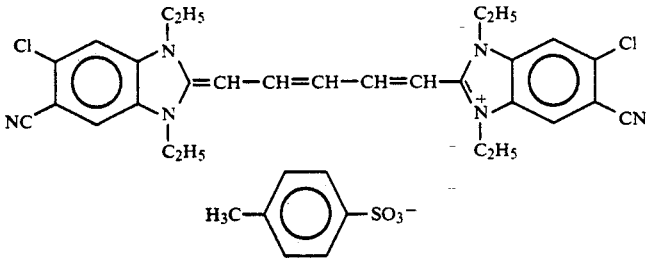

I-51

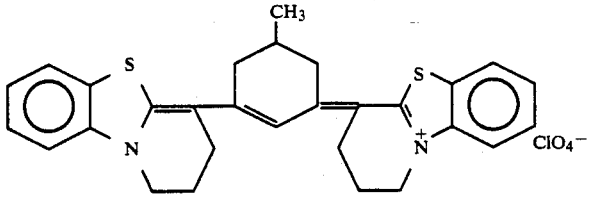

The sensitizing dye of general formula (I) to be used in the present invention is a known compound. The synthesis of the sensitizing dye of general formula (I) can be accomplished by any suitable method as disclosed in JP-A-52-104917, JP-B-48-25652, JP-B-57-22368, F. M. Hamer, *The Chemistry of Heterocyclic Compounds*, Vol. 18, *The Cyanine Dyes and Related Compounds*, A. Weissberger ed., Interscience, New York, 1964, D. M. Sturmer, *The Chemistry of Heterocyclic Compounds*, Vol. 30, A. Weissberger and E. C. Taylor ed., John Willy, New York, p. 441, and Japanese patent application no. 2-270164.

In order to incorporate the cyanine dye of general formula (I) in the silver halide emulsion of the present invention, one may be directly disperse it in the emulsion or incorporate it in the emulsion in the form of solution of water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., either singly or in admixture.

Further, a method as disclosed in U.S. Pat. No. 3,469,987 may be used which comprises dissolving a dye in an organic volatile solvent, dispersing the solution in water or a hydrophilic colloid, and then adding the dispersion to an emulsion. A method as disclosed in JP-B- 46-24185 may be used which comprises directly dispersing a water-insoluble dye in a water-soluble solvent without dissolving it, and then adding the dispersion to an emulsion. A method as disclosed in JP-B-44-23389, JP-B-44-27555 and JP-B-57-22091 may be used which comprises incorporating a dye in an emulsion in the form of a solution in an acid or incorporating a dye in an emulsion in the form of an aqueous solution obtained in the presence of acid or base. A method as disclosed in U.S. Pat. Nos. 3,822,135 and 4,006,025 may be used which comprises incorporating a dye in an emulsion in the form of an aqueous solution or a colloidal dispersion obtained in the presence of a surface active agent. A method as disclosed in JP-A-53-102733 and JP-A-58-105141 may be used which comprises directly dispersing a dye in a hydrophilic colloid, and then incorporating the dispersion in an emulsion. A method as disclosed in JP-A-51-74624 may be used which comprises dissolving a dye in the presence of a compound which causes red shift, and then incorporating the solution in an emulsion.

The dissolution of such a dye in a solvent can be promoted by ultrasonic waves.

The time during which the sensitizing dye is incorporated in the silver halide emulsion of the present invention may be at any step in the process for the preparation of emulsion which has heretofore been considered suitable. For example, as disclosed in U.S. Pat. Nos. 2,735,766, 3,628,960, 4,183,756, and 4,225,666, JP-A-58-184142 and JP-A-60-196749, it may be during the formation of silver halide grains and/or before the desalting of silver halide grains. As disclosed in JP-A-58-113920, it may be shortly before or during chemical ripening, or at any time or step before the coating of an emulsion which has been subjected to chemical ripening. Further, as disclosed in U.S. Pat. No. 4,225,666 and JP-A-58-7629, a sensitizing dye, either singly or in combination with one having a different structure, may be batchwise incorporated in the system during the formation of grains and during the chemical ripening of grains or after the completion of the chemical ripening of grains, or before or during the chemical ripening of grains and after the completion of the chemical ripening of grains. Moreover, the kind of the compounds to be batchwise added and the combination thereof may be altered.

The addition amount of the sensitizing dye of general formula (I) depends on the shape and size of silver halide grains and is normally in the range of $4\times10^{-6}$ to $8\times10^{-3}$ mol per mol of silver halide. For example, if the size of silver halide grains is in the range of 0.2 to 1.3 μm, the amount is preferably in the range of $5\times10^{-5}$ to $2\times10^{-3}$ mol and the range corresponding to a percentage grain surface coverage of 20 to 100%, more preferably 30 to 90%, per mol of silver halide.

The thiocyanate compound to be used in the present invention may be used in the form of an inorganic or organic salt such as alkaline metal salt of thiocyanic acid (such as potassium thiocyanate and sodium thiocyanate), alkali earth metal salt of thiocyanic acid (such as calcium thiocyanate and magnesium thiocyanate), silver thiocyanate, and ammonium salt of thiocyanic acid (such as ammonium thiocyanate).

The incorporation of the thiocyanate compound may be effected before, after or at the same time as the incorporation of the cyanine dye of general formula (I) in the silver halide emulsion. Further, the thiocyanate compound may be added to the system continuously or batchwise between the time before the addition of the sensitizing dye and the time after the completion of the sensitizing dye. Thus, the time during which the thiocyanate compound is incorporated into the system is not specifically limited. However, the thiocyanate compound has been recognized to reduce the inhibition of chemical sensitization on high silver chloride content emulsion, although the degree of the reduction of the inhibition depends on the amount of the thiocyanate compound to be incorporated. Therefore, in order to obtain a higher sensitivity, the thiocyanate compound is preferably added to the system after the middle phase of the chemical sensitization.

The amount of the thiocyanate compound to be incorporated depends on the shape and size of the silver halide grains to which it is incorporated and is normally in the range of $2.5\times10^{-5}$ to $2\times10^{-2}$ mol, preferably $5\times10^{-4}$ to $1.5\times10^{-2}$ mol per mol of silver halide. For example, if the size of the silver halide grains is in the range of 0.2 to 1.3 μm, the amount is preferably in the range of 0.1 to 5 mol, more preferably 0.25 to 2 mol, per mol of silver halide lying on the entire surface of silver halide grains.

Specific examples of the compounds represented by general formulae (II), (III) and (IV) are set forth below, but the present invention should not be construed as being limited thereto:

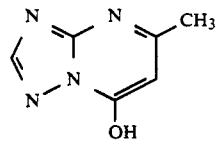

II-1

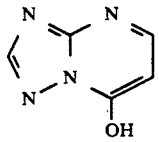

II-2

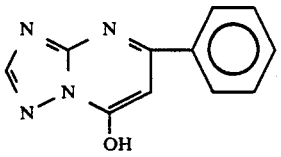

II-3

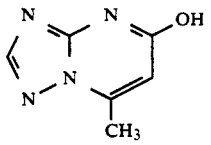

II-4

-continued
II-5
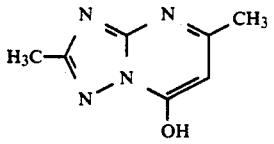
II-6
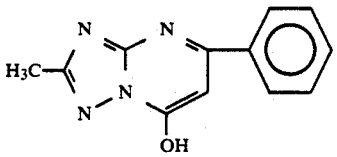
II-7
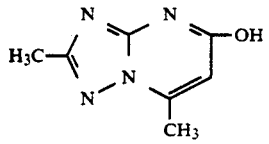
II-8
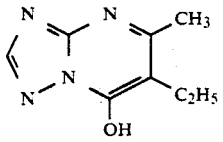
II-9
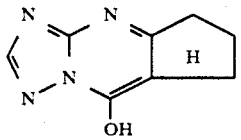
II-10
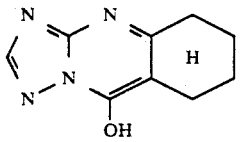
II-11
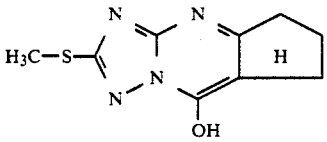
II-12
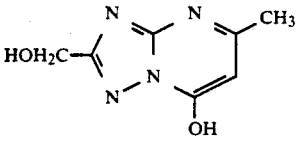
II-13
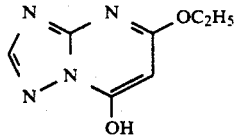
II-14
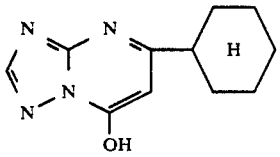
-continued
II-15
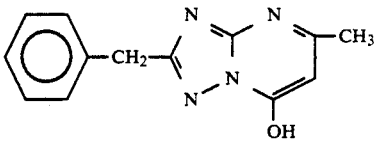
II-16
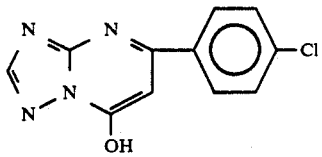
II-17
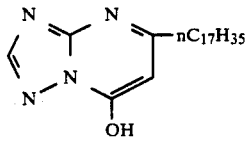
II-18
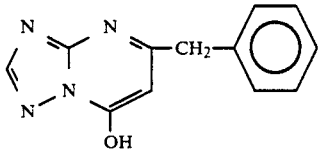
II-19
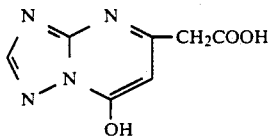
II-20
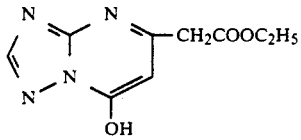
II-21
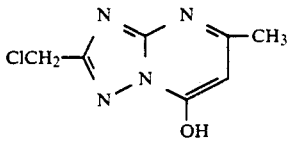
II-22
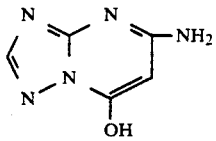
II-23
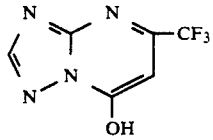
II-24
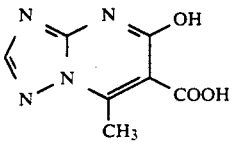

-continued

II-25

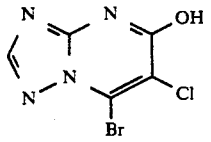

II-26

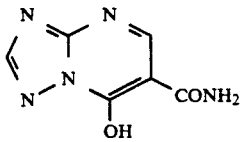

II-27

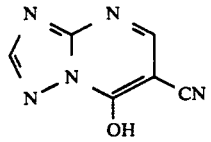

II-28

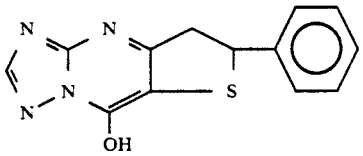

II-29

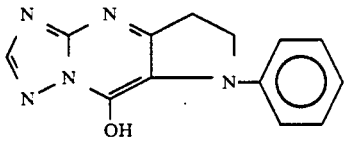

II-30

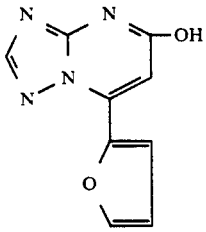

II-31

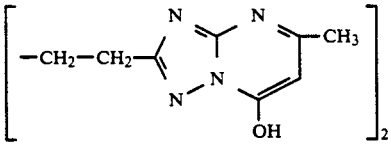

II-32

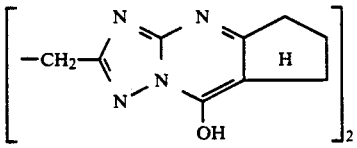

III-1

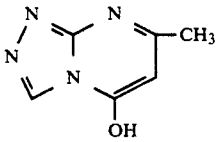

-continued

III-2

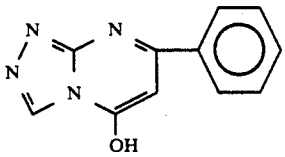

III-3

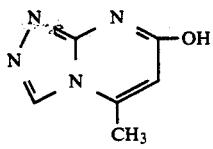

IV-1

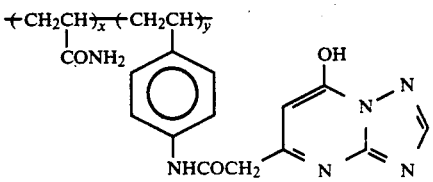

Copolymer wherein y is 5 to 50 mol % and x is 95 to 50 mol %.

IV-2

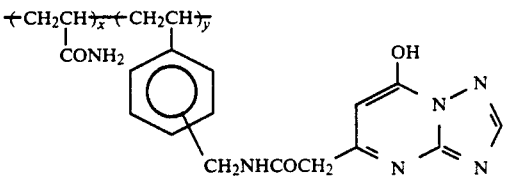

Copolymer wherein y is 5 to 50 mol % and x is 95 to 50 mol %.

IV-3

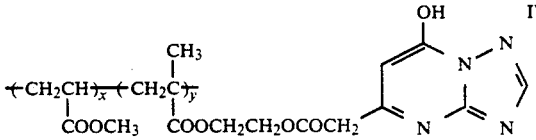

Copolymer wherein y is 5 to 50 mol % and x is 95 to 50 mol %.

IV-4

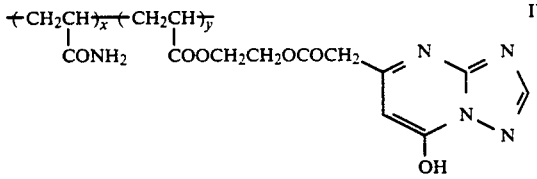

Copolymer wherein y is 5 to 50 mol % and x is 95 to 50 mol %.

IV-5

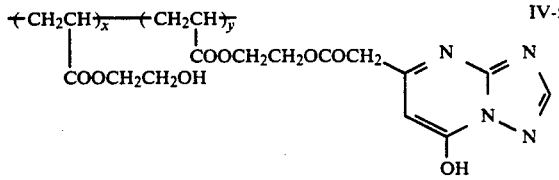

Copolymer wherein y is 5 to 50 mol % and x is 95 to 50 mol %.

The synthesis of the compound represented by general formula (II), (III) or (IV) can be accomplished by any suitable method as disclosed in JP-A-57-211142 and U.S. Pat. No. 4,397,943.

The compound represented by general formula (IV) has molecular weight of $5\times10^3$ to $3\times10^6$, preferably $10^4$ to $10^6$.

In the present invention, the compound represented by general formula (II), (III) or (IV) may be incorporated in the system in an amount of $1\times10^{-5}$ to 0.3 mol, particularly $3\times10^{-4}$ to 0.1 mol, per mol of silver halide. The optimum amount of the compound to be incorporated is preferably selected depending on the grain size of silver halide grains, the halogen composition of silver halide grains, the method and degree of chemical sensitization, the relationship between the emulsion layer of the present invention and other layers, the kind of fog inhibitor, etc. The test method for the selection of the optimum amount of the compound is well known and can be easily effected by those skilled in the art.

In order to incorporate the compound represented by general formula (II), (III) or (IV) into the high silver chloride content emulsion, the same methods as those for incorporating the cyanine dye represented by general formula (I) can be used. For example, the compound may be directly dispersed in the emulsion or may be dissolved in an organic solvent miscible with water or in water, if it is water-soluble, dispersed in a hydrophilic colloid, and then incorporating the dispersion into the emulsion. The aqueous solution may be advantageously alkaline to promote dissolution.

In the present invention, if the compound represented by general formula (II), (III) or (IV) is incorporated into the silver halide emulsion, the incorporation of the compound may be effected at any time between the formation of silver halide grains and the coating of silver halide emulsion, preferably after the completion of the addition of the cyanine dye represented by general formula (I), more preferably after the beginning of chemical ripening, particularly between the time of the completion of chemical ripening and the time of coating.

The high silver chloride content emulsion to be used in the present invention consists of silver halide substantially free of silver iodide (that is, containing silver iodide in an amount of not more than 0.02 mol %) and containing silver chloride in an amount of 80 mol % or more. The silver chloride content is preferably in the range of 95 mol % or more. More preferably, the high silver chloride content emulsion is pure silver chloride.

In the spectral sensitization of grains with a cyanine dye such as those represented by general formula (I), a water-soluble iodide such as potassium iodide is often used in a minute amount such as 0.5 mol % or less per mol of silver halide to promote the adsorption to the silver halide grains or the formation of J-aggregates, providing a higher spectral sensitizability. However, it has been known that the iodide thus added causes the formation of an iodide portion in the vicinity of the surface of silver halide. In the development of silver halide photographic materials, it has been known that iodine ions released from such a iodide portion exhibit a stronger effect of inhibiting development than the above mentioned bromine ions. Therefore, even if such a water-soluble iodide is used in a minute amount such as 0.5 mol % per mol of silver halide, it becomes a great hindrance to ultrarapid processing. Further, if the water-soluble iodide is used in a minute amount on the high silver chloride content emulsion, it is inherently effective only for some cyanine dyes which exhibit a relatively strong adsorption and form J-aggregates. Moreover, if the water-soluble iodide is used in a minute amount, it exerts a very weak effect on the high silver chloride content grains having a 111 plane area proportion of more than 50%, and little or no effect on the octahedral grains and tabular grains having main parallel surfaces formed by 111 planes. The silver iodide content of not more than 0.02 mol % in the silver halide emulsion as defined in the present invention is the minimum allowable level for ultrarapid processing and the upper limit of amount which does not promote the adsorption of cyanine dye and the formation of J-aggregates in silver chloride emulsions.

It can thus be said that the effects of the present invention are attained remarkably on high silver chloride content emulsions having a high 111 plane proportion as 50% or more which hardly cause fogging and provide a higher sensitivity by chemical sensitization than cubic grains, particularly high silver chloride content emulsions containing octahedral grains or tabular grains having opposing parallel main surfaces formed by 111 planes.

The high silver content emulsion to be used in the present invention preferably exhibits an average grain size of 0.1 to 2 μm, more preferably 0.2 to 1.3 μm, as calculated in terms of the diameter of the circle equivalent in projected area. The high silver content emulsion of the present invention may be monodisperse or polydisperse, preferably monodisperse. The grain size distribution, which indicates the degree of monodispersion, is preferably 0.2 or less, more preferably 0.15 or less, as calculated in terms of the ratio (s/d) of statistical standard deviation (s) to average grain size (d).

The high silver chloride content emulsion to be used in the present invention may have phases differing from the core to shell, or a multi-phase structure having junctions, or a phase which is uniform all over the grain, or may have a mixture thereof.

The silver halide grains to be used in the present invention may have a regular crystal form such as a cube, an octahedron, a tetradecahedron, an irregular crystal form or a composite thereof. Alternatively, an emulsion wherein tabular grains having a length/thickness ratio of 5 or more, particulaly 8 or more, account for more than 50% of all grains as calculated in terms of the projected area, may also be preferably used. The emulsion to be used in the present invention may have a mixture of the various crystal forms. The various emulsions may be of the surface latent image type wherein latent images are formed mainly on the surface of grains or the internal latent image type wherein latent images are formed mainly inside grains.

The preparation of the photographic emulsion which can be used in the present invention can be accomplished by any suitable method as described in P. Glafkides, *Chemie et Physique Photographique*, Paul Montel (1967), G. F. Duffin, *Photographic Emulsion Chemistry*, Focal Press, 1966, V. L. Zelikman et al., *Making and Coating Photographic Emulsion*, Focal Press, 1964, F. H. Claes et al., *The Journal of Photographic Science*, (21) pp. 39–50, 1973, F. H. Claes et al., *The Journal of Photographic Science*, (21) pp. 85–92, 1973, JP-B-55-42737, U.S. Pat. Nos. 4,400,463 and 4,801,523, JP-A-62-218959, JP-A-63-213836, and JP-A-63-218938, and Japanese patent application no. 62-291487 (corresponding to JP-A-2-32). In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which a pAg value of a liquid phase in which silver halide grains are formed is maintained constant, may also be used. According to the controlled double jet process, a silver halide emulsion having a regular crystal form and an almost uniform grain size can be obtained.

Further, emulsions prepared by the so-called conversion method which comprises converting the emulsion to the silver halide already formed by or after the completion of the formation of silver halide grains may be used.

If an emulsion is used wherein octahedral grains or tabular grains having 111 planes as parallel main planes, particularly tabular grains with a length/thickness ratio of 5 or more, particularly 8 or more, on which the effects of the present invention are more remarkably exerted, account for 50% or more of all the projected area of grains, the preparation of the high silver chloride content grains is preferably effected with a bispyridinium salt compound as disclosed in Japanese patent application no. 62-291487 (corresponding to JP-A-2-32) as a grain growth modifier, particularly a 4,4'-ethylenebispyridinium salt compound.

In the process for the preparation of the silver halide grains of the present invention, silver halide solvents may be used. Examples of the silver halide solvents which are often used and can be used in the present invention include thioether compounds as disclosed in U.S. Pat. Nos. 3,271,157, 3,574,628, 3,704,130, and 4,276,347, thione compounds and thiourea compounds as disclosed in JP-A-53-144319, JP-A-53-82408, and JP-A-55-77737, and amine compounds as disclosed in JP-A-54-100717. Further, ammonia can be used so long as it does not exert an adverse effect.

In the process for the preparation of the silver halide grains of the present invention, the rate at which the silver salt solution (e.g., an aqueous solution of silver nitrate) and the halide solution (e.g., an aqueous solution of sodium chloride) are added, the amounts of these solutions and the concentration of these solutions may be preferably raised with time. For these methods, reference can be made to British Pat. No. 1,335,925, U.S. Pat. Nos. 3,672,900, 3,650,757, and 4,242,445, and JP-A-55-142329, JP-A-55-158124, JP-A-55-113927, JP-A-58-113928, JP-A-58-111934, and JP-A-58-111936.

In the process for the formation or physical ripening of silver halide grains, cadmium salt, zinc salt, lead salt, thallium salt, rhenium salt, ruthenium salt, iridium salt or a complex salt thereof, rhodium salt or a complex salt thereof, or iron salt or a complex salt thereof may be present in the system. Particularly preferred among these salts are rhenium salt, iridium salt, rhodium salt, and iron salt.

The high silver chloride content emulsion of the present invention may be used without being subjected to chemical sensitization but may be optionally subjected to chemical sensitization before use.

The chemical sensitization can be accomplished by a so-called gold sensitization method with gold compounds (as disclosed in U.S. Pat. Nos. 2,448,060, 3,320,069), a sensitization method with metals such as iridium, platinum, rhodium and palladium (as disclosed in U.S. Pat. Nos. 2,448,060, 2,566,245, 2,566,263), a sulfur sensitization method with sulfur-containing compounds (as disclosed in U.S. Pat. No. 2,222,264), a selenium sensitization method with selenium compounds, or a reduction sensitization method with tin salt, thiourea dioxide, polyamine, or the like, either singly or in combination. The high silver chloride content emulsion of the present invention is preferably subjected to gold sensitization or sulfur sensitization, either singly or in combination. High silver chloride content grains having a high 111 plane proportion of 50% or more are particularly preferably subjected to sulfur sensitization, or sulfur sensitization and gold sensitization in combination.

The emulsion layer in the silver halide photographic material of the present invention can comprise a normal silver halide besides the high silver chloride content grains of the present invention.

In the photographic emulsion containing high silver chloride content grains of the present invention, the high silver chloride content grains are present in an amount of 70% or more, preferably 90% or more, particularly 95% or more, of all the silver halide grains as calculated in terms of projected area. In the silver halide grains to be incorporated in the emulsion layer free of the high silver chloride content emulsion of the present invention, high silver chloride content grains containing silver chloride substantially free of silver iodide in an amount of 80% or more, preferably 95% or more are present in an amount of 70% or more, preferably 90% or more, particularly 95% or more of all the silver halide grains in the emulsion layer as calculated in terms of projected area.

The silver halide emulsion of the present invention may comprise methine dyes other than the cyanine dye of the present invention and/or supersensitizing agent for the purpose of extending the wavelength range to which it is sensitive, or supersensitization. If silver halide grains other than the silver halide grains of the present invention are contained in the same layer or separate layers, the silver halide grains may be spectrally sensitized with other methine dyes and supersensitizing agents, not to mention the cyanine dye of the present invention.

Examples of a spectral sensitizing dye to be used in the present invention include cyanine dye, merocyanine dye, complex cyanine dye, complex merocyanine dye, holopolar cyanine dye, hemicyanine dye, styryl dye and hemioxonol dye. Particularly useful among these dyes are cyanine dye, merocyanine dye, and complex merocyanine dye. Any of the nuclei which are commonly used as a basic heterocyclic nucleus for a cyanine dye can be applied to these dyes. Examples of a suitable nucleus which can be applied to these dyes include a pyrroline nucleus, an oxazoline nucleus, a thiazoline nucleus, a selenazoline nucleus, a pyrrole nucleus, an oxazole nucleus, a thiazole nucleus, a selenazole nucleus, an imidazole nucleus, a tetrazole nucleus, a pyridine nucleus, a tellurazole nucleus and a nucleus obtained by fusion of alicyclic hydrocarbon rings to the nucleus or a nucleus obtained by fusion of aromatic hydrocarbon rings to the nucleus, e.g., indolenine nucleus, benzindolenine nucleus, indole nucleus, benzoxazole nucleus, naphthooxazole nucleus, benzimidazole nucleus, naphthoimidazole nucleus, benzothiazole nucleus, naphthothiazole nucleus, benzoselenazole nucleus, naphthoselenazole nucleus, quinoline nucleus, and benzotellurazole nucleus. These nuclei may contain substituents on the carbon atoms.

Any of the nuclei having a ketomethylene structure which are commonly used for merocyanine dyes can be applied to a merocyanine dye or a complex merocyanine dye. Particularly useful examples of such nuclei include 5- or 6-membered heterocyclic nuclei such as a pyrazoline-5-one nucleus, a thiohydantoin nucleus, a 2-thiooxazoline-2,4-dione nucleus, a thiazolidine-2,4-dione nucleus, a rhodanine nucleus, a thiobarbituric acid nucleus, and a 2-thioselenazolidine-2,4-dione nucleus.

These sensitizing dyes can be used either singly or in combination. A combination of sensitizing dyes is often used for the purpose of supersensitization. Typical examples of such a combination of sensitizing dyes are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,614,609, 3,837,862, and 4,026,707, British Pat. Nos. 1,344,281, and 1,507,803, JP-B-43-4936, and JP-B-53-12375, and JP-A-52-110618, and JP-A-52-109925.

Typical examples of supersensitizers include bispyridinium salt compounds as disclosed in JP-A-59-142541, stilbene derivatives as disclosed in JP-B-59-18691, water-soluble bromides as disclosed in JP-B-49-46932, condensates of an aromatic compound and formaldehyde as disclosed in U.S. Pat. No. 3,743,510, cadmium salts, and azaindene compounds.

The incorporation of these methine dyes into the silver halide emulsion may be effected at any step during the preparation of the emulsion which has heretofore been known to be suitable for this purpose. Similarly, the incorporation of these methine dyes in the emulsion may be effected in any way which has heretofore been known to be suitable for this purpose and in any amount which has heretofore been known suitable for this purpose. Specifically, the incorporation of these methine dyes in the emulsion may be effected at the step as defined for the cyanine dye represented by general formula (I) in the way defined for the cyanine dye in the amount defined for the cyanine dye.

The silver halide emulsion prepared according to the present invention can be incorporated into color photographic light-sensitive materials and black-and-white photographic light-sensitive materials.

Specific examples of these color photographic light-sensitive materials include color paper, color film for picture taking, and color reversal film. Specific examples of the black-and-white photographic light-sensitive materials include X-ray film, general purpose film for picture taking, and film for printing light-sensitive material. In particular, the silver halide emulsion of the present invention may be preferably applied to in color paper.

Other additives to be incorporated in the photographic light-sensitive material to which the emulsion of the present invention is applied are not specifically limited. For these additives, reference can be made to *Research Disclosure* Nos. 17643 (vol. 176) and 18716 (vol. 187).

These additives are listed below.

| Kind | RD 17643 | RD 18716 |
|---|---|---|
| 1. Chemical Sensitizer | Page 23 | Page 648, right column |
| 2. Sensitivity Increasing Agent | | Page 648, right column |
| 3. Spectral Sensitizer and Supersensitizer | Pages 23 to 24 | Page 648, right column to page 649, right column |
| 4. Brightening Agent | Page 24 | |

-continued

| Kind | RD 17643 | RD 18716 |
|---|---|---|
| 5. Antifoggant and Stabilizer | Pages 24 to 25 | Page 649, right column |
| 6. Light-Absorbent, Filter Dyes and Ultraviolet Absorbent | Pages 25 to 26 | Page 649, right column to page 650, left column |
| 7. Stain Inhibitor | Page 25, right column | Page 650, left column to right column |
| 8. Dye Image Stabilizer | Page 25 | |
| 9. Hardening Agent | Page 26 | Page 651, left column |
| 10. Binder | Page 26 | Page 651, left column |
| 11. Plasticizer and Lubricant | Page 27 | Page 650, right column |
| 12. Coating Aid and Surface Active Agent | Pages 26 to 27 | Page, 650, right column |
| 13. Antistatic Agent | Page 27 | Page 650, right column |

Particularly preferred among these antifoggants and stabilizers listed as additives are azoles (e.g., benzothiazolium salt, nitroimidazoles, nitrobenzimidazoles, chlorobenzimidazoles, bromobenzimidazoles, nitroindazoles, benzotriazoles, aminotriazoles), mercapto compounds (e.g., mercaptothiazoles, mercaptobenzothiazoles, mercaptobenzoimidazoles, mercaptothiadiazoles, mercaptotetrazoles (particularly 1-phenyl-5-mercaptotetrazole), mercaptopyrimidines, mercaptotriazines), thioketo compounds such as oxazolinethione, azaindenes (e.g., triazaindenes, tetrazaindenes (particularly 4-hydroxy-substituted (1,3,3a,7)tetrazaindenes), pentazaindenes), benzenethiosulfonic acid, benzenesulfinic acid, and benzenesulfonic amide.

The preferred color couplers are nondiffusive couplers containing a hydrophobic group called the ballast group in the molecule or polymerized couplers. These color couplers may be either two-equivalent or four equivalent with respect to silver ion. Colored couplers which exhibit an effect of color correction or couplers which release a development inhibitor upon development (so-called DIR coupler) may be incorporated into the photographic light-sensitive material. Alternatively, colorless DIR coupling compounds which undergo a coupling reaction to give a colorless product and release a development inhibitor may be incorporated into the photographc light-sensitive material.

Examples of the magenta couplers include a 5-pyrazolone coupler, a pyrazolobenzimidazole coupler, a pyrazolotriazole coupler, a pyrazolotetrazole coupler, a cyanoacetyl coumarone coupler and an open chain acylacetonitrile coupler. Examples of the yellow couplers include an acylacetamide coupler (e.g., benzoylacetoanilide, pivaloyl acetanilide). Examples of the cyan couplers include naphthol coupler and phenol coupler. Examples of these cyan couplers preferred because of excellent fastness of image include phenol couplers containing an ethyl group in the meta-position in the phenol nucleus, a 2,5-diacylamino-substituted phenol coupler, phenol couplers containing a phenylureide group in the 2-position and an acylamino group in the 5-position, and couplers substituted by a sulfonamide, an amide or the like in the 5-position, as described in U.S. Pat. Nos. 3,772,002, 2,772,162, 3,758,308, 4,126,396, 4,334,011, 4,327,173, 3,446,622, 4,333,999, 4,451,559, and 4,427,767.

Two or more of these couplers may be incorporated into the same layer to satisfy the properties required of the light-sensitive material. Alternatively, one of these couplers may be incorporated into two or more different layers.

Typical examples of discoloration inhibitors include hydroquinones, 6-hydroxychromanes, 5-hydroxycoumaranes, spirochlomane, p-alkoxyphenols, hindered phenols such as bisphenols, gallic acid derivatives, methylenedioxanebenzenes, aminophenols, hindered amines, and ether and ester derivatives obtained by silylating or alkylating a phenolic hydroxyl group in these compounds. Alternatively, nickel bissalycylaldoximate complex and nickel bis-N,N-dialkyldithiocarbamate complex may be used.

The processing of the light-sensitive material prepared according to the present invention may be accomplished by any known method with any known processing solution. The processing temperature is normally selected in the range between 18° C. and 50° C., but may fall below 18° C. or may exceed 50° C. The light-sensitive material of the present invention may be subjected to development in which silver images are formed (black-and-white processing) or color photographic processing comprising development in which dye images are formed.

The black-and-white developer may comprise known developing agents such as dihydroxybenenes (e.g., hydroquinone), 3-pyrazolidones (e.g., 1-phenyl-3-pyrazolidone), aminophenols (e.g., N-methyl-p-aminophenol), either singly or in combination.

The color developer normally consists of an alkaline aqueous solution containing a color developing agent. Such a color developing agent may be a known primary aromatic amine developing agent such as phenylenediamine (e.g., 4-amino-N,N-diethyl-aniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline).

Further, color developing agents as disclosed in L. F. A. Meson, *Photographic Processing Chemistry*, Focal Press, 1966, pp. 226–229, U.S. Pat. No. 2,193,015, and 2,592,364, and JP-A-48-64933 may be used.

The color developer normally may further contain a pH buffer such as a sulfite, a carbonate, a borate and a phosphate of an alkaline metal or a development inhibitor or fog inhibitor such as bromides, iodides and organic fog inhibitors. If desired, the color developer may further contain a water softener, preservatives such as hydroxylamine, organic solvents such as benzyl alcohol and diethylene glycol, development accelerators such as polyethylene glycol, quaternary ammonium salts and amines, dye-forming couplers, competing couplers, fogging agents such as sodium boron hydride, auxiliary developing agents such as 1-phenyl-3-pyrazolidone, thickening agents, polycarboxylic chelating agents as disclosed in U.S. Pat. No. 4,083,723, and oxidation inhibitors as disclosed in West German patent application (OLS) no. 2,622,950.

The photographic light-sensitive material which has been color-developed in color photographic processing is normally subjected to bleach. However, bleach may be effected simultaneously with fixation, or these two steps may be carried out separately. Bleaching agents to be used include compounds of polyvalent metals, e.g., iron(III), cobalt(III), chromium(IV) and copper(II), peroxides, quinones, and nitro compounds. Examples of these bleaching agents include ferricyanides, bichromates, organic complex salts of iron(III) or cobalt(III) with aminopolycarboxylic acis, e.g., ethylenediaminetetraacetic acid, nitrilotriacetic acid, and 1,3 diamino-2-propanetetraacetic acid, or citric acid, tartaric acid, malic acid, etc., persulfates, permanganates, and nitrosophenol. Particularly useful among these compounds are potassium ferricyanide, ferric sodium ethylenediaminetetraacetate(III) and ferric ammonium ethylenediaminetetraacetate(III). In particular, ferric ethylenediaminetetraacetate complex salts are useful both for a bleaching solution and a blix solution.

The bleaching or blix solution may comprise bleach accelerators as disclosed in U.S. Pat. Nos. 3,042,520 and 3,241,966 and JP-B-45-8506 and JP-B-45-8836, and thiol compounds as disclosed in JP-A-53-65732, as well as other various additives. The light-sensitive material which has been subjected to bleach or blix may be then subjected to washing or to stabilization alone.

The present invention will be further described in the following examples, but the present invention should not be construed as being limited thereto.

EXAMPLE 1

| | |
|---|---|
| (Solution 1) | |
| Water | 1,000 cc |
| NaCl | 5.0 g |
| Gelatin | 32 g |
| (Solution 2) | |
| $AgNO_3$ | 25.6 g |
| Water to make | 200 cc |
| (Solution 3) | |
| KBr | 12.54 g |
| NaCl | 4.12 g |
| Water to make | 200 cc |
| (Solution 4) | |
| 1-Benzyl-4-[2-(1-benzyl-4-pyridinio)-ethyl]pyridinium dichloride | 0.55 g |
| Water to make | 200 cc |
| (Solution 5) | |
| $AgNO_3$ | 128 cc |
| Water to make | 600 cc |
| (Solution 6) | |
| KBr | 62.72 g |
| NaCl | 17.64 g |
| Water to make | 600 cc |

Solution 1 was heated to a temperature of 56° C. Solution 2 and Solution 3 were simultaneously added to Solution 1 with vigorous stirring over 30 minutes. After 10 minutes, Solution 4 was added to the system. Solution 5 and Solution 6 were simultaneously added to the system over 20 minutes. Five minutes after the completion of the addition, the temperature of the system was lowered. A copolymer of isobutene and monosodium maleate was added to the system as a flocculating agent. The resulting precipitate was washed with water so that it was desalted. Water and deionized ossein gelatin were added to the system. The pH value of the system was then adjusted to 6.2. As a result, a monodisperse emulsion of octahedral silver bromochloride grains with an average side length of 0.45 μm, a fluctuation coefficient of 0.15 (determined by dividing the standard deviation by the average side length: s/d), and a silver chloride content of 30 mol % was obtained. The emulsion was then subjected to optimum chemical sensitization with chloroauric acid and sodium thiosulfate (this emulsion will be hereinafter referred to as "Emulsion 1").

A monodisperse emulsion of octahedral silver bromochloride grains with a silver chloride content of 80 mol % was prepared as Emulsion 2 in the same manner as in Emulsion 1 except that the content of KBr and NaCl in Solution 3 were altered to 3.58 g and 8.53 g, respectively, the amount of KBr and NaCl in Solution 6 were altered to 17.92 g and 39.67 g, respectively, and the time during which Solutions 2 and 3 are added to the system was each altered to 15 minutes. A monodisperse emulsion of octahedral silver chloride grains with a silver chloride content of 100 mol % was prepared as Emulsion 4 in the same manner as in Emulsion 1 except that Solutions 3 and 6 were free of KBr, the amount of NaCl in Solutions 3 and 6 were altered to 10.29 g and 48.48 g, respectively, and the time during which Solutions 2 and 3 were added to the system was altered to 8 minutes. The average grain size of Emulsions 2, 3 and 4 were each 0.45 μm. The fluctuation coefficient (determined by dividing the standard deviation by the average side length: s/d) of Emulsions 2 and 3 were each 0.16. The fluctuation coefficient of Emulsion 4 was 0.17.

To Emulsions 1 to 4 thus prepared were each added the cyanine dye I-29 of the present invention in the form of a methanol solution in an amount of $5.40\times10^{-4}$ mol per mol of silver halide at a temperature of 40° C. To these emulsions were then added potassium thiocyanate and tetrazaindene compound II-1 of the present invention as set forth in Table 1 at a temperature of 40° C. to prepare specimens as set forth in Table 1.

As a support there was used a cellulose triacetate film support. The coated amount of these emulsions were each predetermined so that the amount of silver and gelatin reached 1.25 g/m$^2$ and 3.0 g/m$^2$, respectively. An aqueous solution containing 0.1 g of sodium dodecylbenzenesulfonate, 0.22 g/l of p-sulfostyrene sodium homopolymer, 3.1 g/l of sodium salt of 2-hydroxy-4,6-dichloro-1,3,5-triazine, and 50 g/l of gelatin as main components was simultaneously coated as an upper layer in such an amount that the amount of gelatin reached 1.0 g/m$^2$.

These coated specimens were each exposed to light from a tungsten light source (color temperature: 2,854° K.) through a red sharp cut filter SC-60 available from Fuji Photo Film Co., Ltd. (filter with a transmission of about 38% at 600 nm which transmits light of a wavelength longer than about 580 nm) and a continuous wedge.

These specimens thus exposed were each developed with the developer having the formulation as set forth below at a temperature of 20° C. for 30 seconds, stopped, fixed, and then washed with water. These specimens were then measured for density by means of a P type densitometer available from Fuji Photo Film Co., Ltd. to determine red filter sensitivity (SR). The results are set forth in Table 1.

| Formulation of developer | |
|---|---|
| Methol | 2.5 g |
| L-ascorbic acid | 10.0 g |
| Sodium chloride | 0.5 g |
| Nabox | 35.0 g |
| Water to make | 1,000 ml |
| pH (20° C.) | 9.8 |

The reference point at which the sensitivity is determined is the density point of "fog+0.5". The sensitivity is represented by the reciprocal of the exposure required to give the density of "fog+0.5". The values set forth in Table 1 are represented relative to that of Coated Specimen No. 1-1 comprising a silver bromochloride emulsion having a silver chloride content of 30 mol % (Emulsion 1) and free of a thiocyanate and a tetrazaindene compound as 100.

As an example of the constitution of the present invention which enables remarkable formation of J-aggregates with a high silver chloride content octahedral grain emulsion and silver chloride, the absorption spectrum of Coated Specimen Nos. 1-13, 1-14 and 1-16 are shown in FIG. 1.

TABLE 1

| Specimen No. | Emulsion No. | % Silver chloride content | Added amount of KSCN × $10^{-3}$ mol/molAg | Added amount of Compound II-1 × $10^{-3}$ mol/molAg | Relative red sensitivity | Remarks |
|---|---|---|---|---|---|---|
| 1-1 | (1) | 30 | — | — | 100 (reference) | Comparative |
| 1-2 | " | " | 3.0 | — | 76 | " |
| 1-3 | " | " | — | 4.0 | 191 | " |
| 1-4 | " | " | 3.0 | 4.0 | 162 | " |
| 1-5 | (2) | 80 | — | — | 41 | " |
| 1-6 | " | " | 3.0 | — | 145 | " |
| 1-7 | " | " | — | 4.0 | 78 | " |
| 1-8 | " | " | 3.0 | 4.0 | 288 | Present Invention |
| 1-9 | (3) | 95 | — | — | 27 | Comparative |
| 1-10 | " | " | 3.0 | — | 148 | " |
| 1-11 | " | " | — | 4.0 | 58 | " |
| 1-12 | " | " | 3.0 | 4.0 | 324 | Present Invention |
| 1-13 | (4) | 100 | — | — | 26 | Comparative |
| 1-14 | " | " | 3.0 | — | 145 | " |
| 1-15 | " | " | — | 4.0 | 55 | " |
| 1-16 | " | " | 3.0 | 4.0 | 316 | Present Invention |
| 1-17 | (4) | 100 | — | Compound (a) | 13 | Comparative |
| 1-18 | " | " | 3.0 | " | 81 | " |
| 1-19 | (4) | 100 | — | Compound (b) | 51 | Comparative |

TABLE 1-continued

| Specimen No. | Emulsion No. | % Silver chloride content | Added amount of KSCN × $10^{-3}$ mol/molAg | Added amount of Compound II-1 × $10^{-3}$ mol/molAg | Relative red sensitivity | Remarks |
|---|---|---|---|---|---|---|
| 1-20 | " | " | 3.0 | " | 129 | " |

(a)

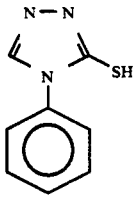

(b)

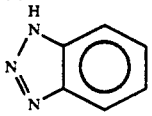

EXAMPLE 2

Emulsion 5 to be used in Example 2 was prepared as follows:

| | |
|---|---|
| (Solution 1) | |
| Water | 1,000 cc |
| NaCl | 5.5 g |
| Gelatin | 32 g |
| (Solution 2) | |
| Sulfuric acid (1N) | 24 cc |
| (Solution 3) | |
| 1% Aqueous solution of 1,4-dimethylimidazolidine-5-thione | 3 cc |
| (Solution 4) | |
| KBr | 15.66 g |
| NaCl | 3.30 g |
| Water to make | 200 cc |
| (Solution 5) | |
| $AgNO_3$ | 32 g |
| Water to make | 200 cc |
| (Solution 6) | |
| KBr | 62.72 g |
| NaCl | 13.22 g |
| $K_2IrCl_6$ (0.001%) | 4.54 cc |
| Water to make | 600 cc |
| (Solution 7) | |
| $AgNO_3$ | 128 cc |
| Water to make | 600 cc |

Solution 1 was heated to a temperature of 56° C. Solution 2 and Solution 3 were added to Solution 1. Thereafter, Solution 4 and Solution 5 were simultaneously added to the system over 30 minutes. After 10 minutes, Solution 6 and Solution 7 were simultaneously added to the system over 20 minutes. Five minutes after the addition, the temperature of the system was lowered. A copolymer of isobutene and monosodium maleate was added to the system as a flocculating agent. The resulting precipitate was washed with water so that it was desalted. Water and deionized ossein gelatin were added to the system. The pH value and the pAg value of the system were then adjusted to 6.2 and 7.4, respectively. As a result, a monodisperse emulsion of cubic silver bromochloride grains with an average side length of 0.45 μm, a fluctuation coefficient of 0.08 (determined by dividing the standard deviation by the average side length: s/d), and a silver chloride content of 30 mol % was obtained. The emulsion was then subjected to optimum chemical sensitization with sodium thiosulfate to prepare Emulsion 5.

A monodisperse emulsion of cubic silver bromochloride grains with a silver chloride content of 80 mol % was prepared as Emulsion 6 in the same manner as in Emulsion 5 except that the content of KBr and NaCl in Solution 4 were altered to 4.47 g and 8.80 g, respectively, the amount of KBr and NaCl in Solution 6 were altered to 17.92 g and 35.26 g, respectively, and the time during which Solutions 4 and 5 are added to the system was altered to 10 minutes. A monodisperse emulsion of cubic pure silver chloride grains with a silver chloride content of 100 mol % was prepared as Emulsion 7 in the same manner as in Emulsion 5 except that Solutions 4 and 6 were free of KBr, the amount of NaCl in Solutions 4 and 6 were altered to 11.00 g and 44.05 g, respectively, and the time during which Solutions 4 and 5 are added to the system was altered to 8 minutes. The average grain size of Emulsions 6 and 7 were each 0.45 μm. The fluctuation coefficient (determined by dividing the standard deviation by the average side length: s/d) of Emulsions 6 and 7 were 0.08 and 0.09, respectively.

To Emulsions 5 to 7 thus prepared were added the cyanine dye I-30 of the present invention in the form of methanol solution in an amount of $3.10\times10^{-4}$ mol per mol of silver halide at a temperature of 40° C. To these emulsions were then added sodium thiocyanate and tetrazaindene compound II-9 of the present invention as set forth in Table 2 at a temperature of 40° C. to prepare specimens as set forth in Table 2.

As the support there was used a polyethylene terephthalate film support. The coated amount of these emulsions were each predetermined so that the amount of silver and gelatin reached 1.6 g/m² and 3.0 g/m², respectively. An aqueous solution containing 0.1 g of sodium dodecylbenzenesulfonate, 0.22 g/l of p-sulfostyrene sodium homopolymer, 3.1 g/l of sodium salt of 2-hydroxy-4,6-dichloro-1,3,5-triazine, and 50 g/l of gelatin as main components was simultaneously coated as the upper layer in an amount so that the amount of gelatin reached 1.0 g/m².

These coated specimens were each divided into two batches. One of the two batches was exposed to light from a tungsten light source (color temperature: 2,854° K.) through a band-pass filter BPN-60 available from Fuji Photo Film Co., Ltd. (hereinafter referred to as "Filter 1") (having maximum transmission at about 600 nm) and a continuous wedge, and the other was exposed to light from the tungsten light source through a red sharp cut filter SC-66 available from Fuji Photo Film Co., Ltd. (hereinafter referred to as "Filter 2") (filter which exhibits a transmission of about 44% at 660 nm and transmits light of a wavelength longer than about 640 nm) and a continuous wedge.

These specimens thus exposed were each developed with the same developer as used in Example 1 at a temperature of 20° C. for 30 seconds, stopped, fixed, and then washed with water. These specimens were then measured for density by means of a P type densitometer available from Fuji Photo Film Co., Ltd. to determine sensitivity with Filter 1 and sensitivity with Filter 2. The results are set forth in Table 2.

The reference point at which the sensitivity is determined is the density point of "fog+0.5". The sensitivity is represented by the reciprocal of the exposure required to give the density of "fog+0.5". The values set forth in Table 2 are represented relative to that of Coated Specimen No. 2-1 prepared from a silver bromochloride emulsion having a silver chloride content of 30 mol % (Emulsion 5) and free of sodium thiocyanate and tetrazaindene compound which had been exposed to light through Filters 1 and 2, respectively, as 100.

Figure 2:
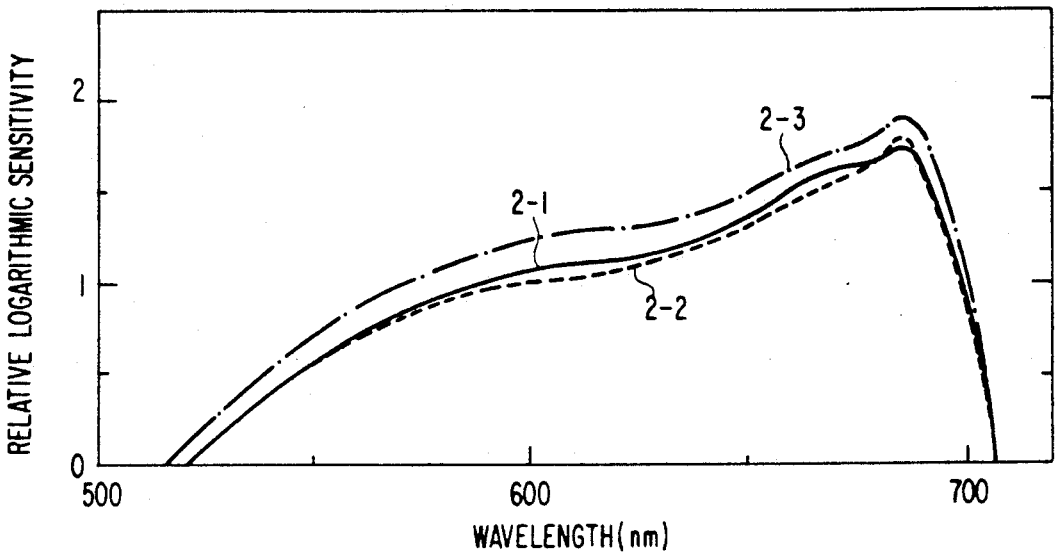
FIG. 2 is a graph illustrating the spectral sensitivity distribution spectrum of Specimens 2-1 (solid line), 2-2 (dotted line) and 2-3 (chain line) of Example 2 which give a density of 0.3.
Figure 3:
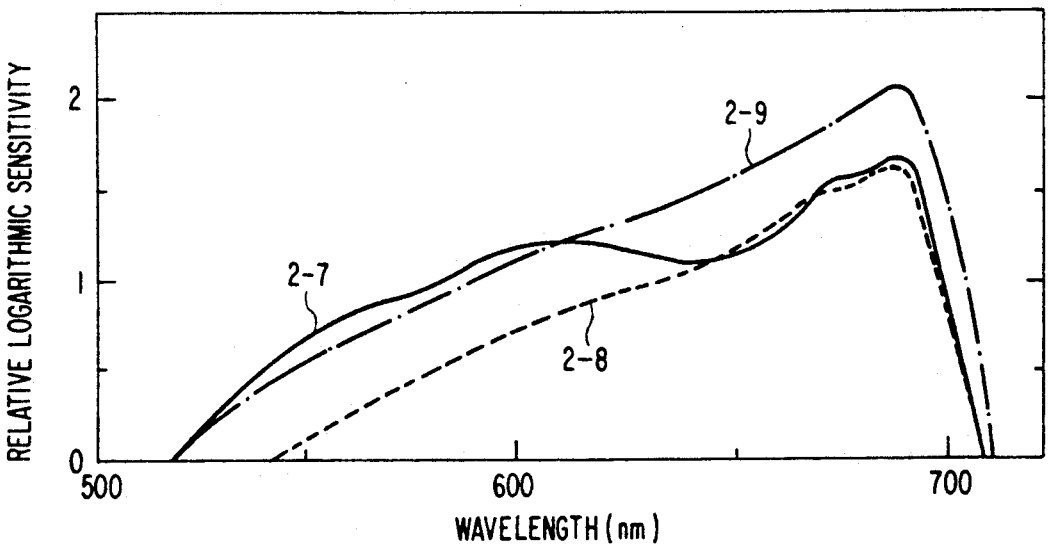
FIG. 3 is a graph illustrating the spectral sensitivity distribution spectrum of Specimens 2-7 (solid line), 2-8 (dotted line) and 2-9 (chain line) of Example 2 which give a density of 0.3.
Figure 4:
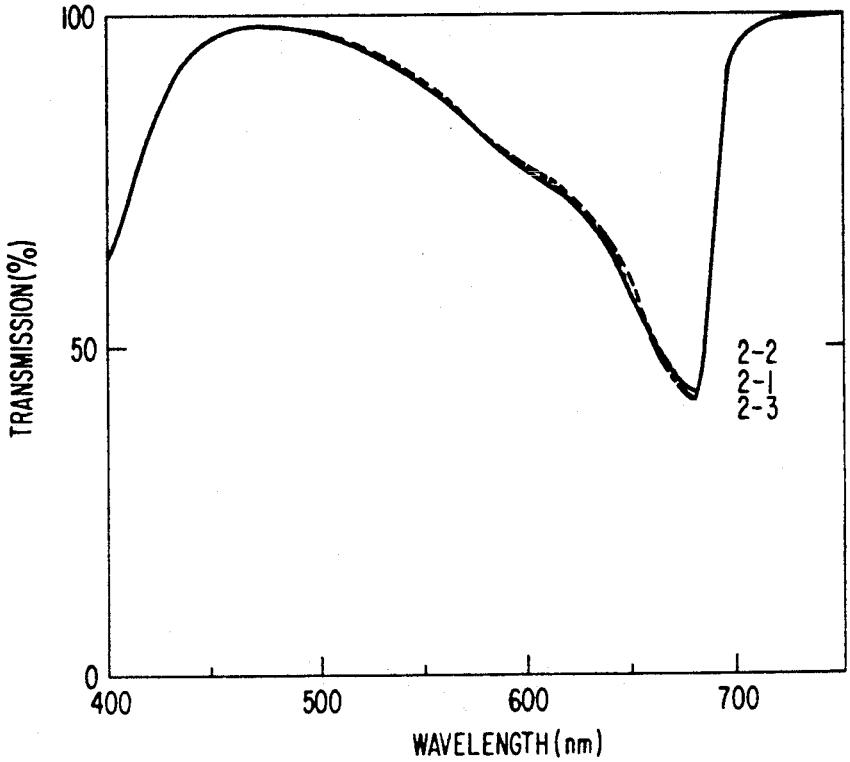
FIG. 4 is a graph illustrating the transmission absoption spectrum of Specimens 2-1 (solid line), 2-2 (dotted line) and 2-3 (chain line) of Example 2.
Figure 5:
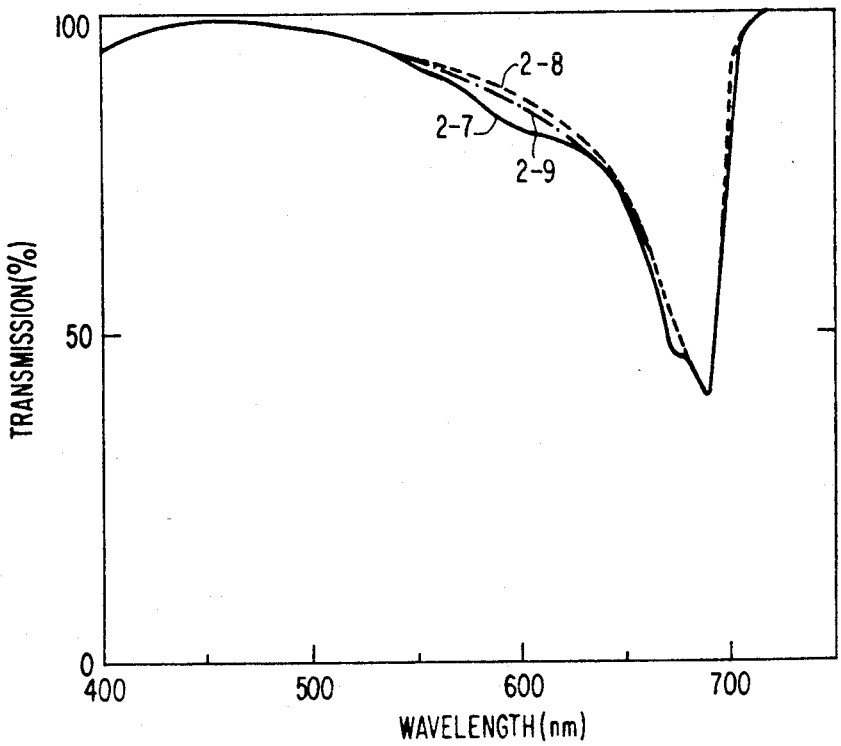
FIG. 5 is a graph illustrating the transmission absoption spectrum of Specimens 2-7 (solid line), 2-8 (dotted line) and 2-9 (chain line) of Example 2.

In order to better understand the effects of the present invention, the spectral sensitivity distribution spectrum and spectral absorption spectrum of Coated Specimens 2-1, 2-2 and 2-3 which have been subjected to the same develoment are shown in FIG. 2 and FIG. 4, respectively, and the spectral sensitivity distribution spectrum and spectral absorption spectrum of Coated Specimens 2-7, 2-8 and 2-9 which have been subjected to the same development are shown in FIG. 3 and FIG. 5, respectively.

TABLE 2

| Specimen No. | Emulsion No. and % Silver chloride content | | Added amount of NaSCN × $10^{-3}$ mol/molAg | Added amount of Compound II-9 × $10^{-3}$ mol/molAg | Relative sensitivity Filter 1 | Relative sensitivity Filter 2 | Remarks |
|---|---|---|---|---|---|---|---|
| 2-1 | (5) | 30 | — | — | 100 (reference) | 100 (reference) | Comparative |
| 2-2 | " | " | 2.7 | — | 83 | 91 | " |
| 2-3 | " | " | 2.7 | 3.6 | 174 | 219 | " |
| 2-4 | (6) | 80 | — | — | 135 | 87 | " |
| 2-5 | " | " | 2.7 | — | 43 | 85 | " |
| 2-6 | " | " | 2.7 | 3.6 | 132 | 309 | Present Invention |
| 2-7 | (7) | 100 | — | — | 158 | 83 | Comparative |
| 2-8 | " | " | 2.7 | — | 41 | 79 | " |
| 2-9 | " | " | 2.7 | 3.6 | 126 | 324 | Present Invention |
| 2-10 | (7) | 100 | 2.7 | Compound (b) 3.6 | 37 | 76 | Comparative |
| 2-11 | (7) | 100 | 2.7 | Compound (c) 3.6 | 68 | 120 | Comparative |

(c)

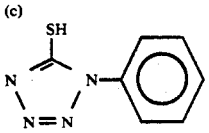

EXAMPLE 3

| | |
|---|---|
| (Solution 1) | |
| Water | 1,000 cc |
| NaCl | 10 g |
| 1-Benzyl-4-[2-(1-benzyl-4-pyridinio)ethyl]pyridinium chloride | 0.85 g |
| Gelatin | 30 g |
| (Solution 2) | |
| $AgNO_3$ | 25.6 g |
| Water to make | 200 cc |

-continued

| | |
|---|---|
| (Solution 3) | |
| KBr | 3.58 g |
| NaCl | 11.05 g |
| Water to make | 200 cc |
| (Solution 4) | |
| $AgNO_3$ | 128 cc |
| Water to make | 600 cc |
| (Solution 5) | |
| KBr | 17.92 g |
| NaCl | 47.24 g |
| Water to make | 600 cc |

Solution 1 was heated to a temperature of 56° C. Solution 2 and Solution 3 were simultaneously added to Solution 1 with vigorous stirring in 15 minutes. After 10 minutes, Solutions 4 and 5 were simultaneously added to the system over 20 minutes. Five minutes after the completion of the addition, the temperature of the system was lowered. A copolymer of isobutene and monosodium maleate was added to the system as a flocculating agent. The resulting precipitate was washed with water so that it was desalted. Water and deionized ossein gelatin were added to the system. The pH value and pAg value of the system were then adjusted to 6.2 and 7.3, respectively. As a result, a monodisperse emulsion of hexagonal tabular silver bromochloride grains with an average diameter of 1.12 μm, an average diameter/thickness ratio of 14, and a silver chloride content of 80 mol % was obtained. The emulsion was then subjected to optimum chemical sensitization with chloroauric acid and sodium thiosulfate (this emulsion will be hereinafter referred to as "Emulsion 8").

A monodisperse emulsion of tabular pure silver chloride grains with a silver chloride content of 100 mol % was prepared as Emulsion 9 in the same manner as in Emulsion 8 except that Solutions 3 and 5 were free of KBr, the content of NaCl in Solutions 3 and 5 were altered to 12.81 g and 56.05 g, respectively, and the time during which Solutions 2 and 3 are added to the system was altered to 8 minutes. Emulsion 9 thus obtained exhibited an average grain diameter of 1.14 μm and an average diameter/thickness ratio of 12.7.

To Emulsion 8 thus prepared was added the cyanine dye I-15 of the present invention in the form of methanol solution in an amount of $5.40\times10^{-4}$ mol per mol of silver halide at a temperature of 40° C. The material was then divided into four batches. To these emulsions were then added potassium thiocyanate and tetrazaindene compound II-2 of the present invention as set forth in Table 3 at a temperature of 40° C. Emulsion 9 previously prepared was then divided into two batches. To one of the two batches was added the cyanine dye I-15 in an amount of $5.40\times10^{-4}$ mol per mol of silver halide. To the other batch was added the cyanine dye I-4 of the present invention in an amount of $6.00\times10^{-4}$ mol per mol of silver halide. The two batches were each further divided into two batches. To these batches were each added potassium thiocyanate and compounds as set forth in Table 3 in the amounts as set forth in Table 3 at a temperature of 40° C. After 20 minutes, to these batches were each added an emulsion dispersion obtained by dissolving 1-(2,4,6-trichlorophenyl)-3-(2-chloro-5-tetradecanoylaminoanilino)-5-pyrazolone as magenta coupler and Cpd-1 and Cpd-2 as dye stabilizers in ethyl acetate, biscyclohexyl phthalate and tritolyl phosphate, and then emulsion-dispersing the solution in a 10% aqueous gelatin solution containing 10 ml of 10% sodium dodecylbenzenesulfonate in an amount of 138.9 g per mol of silver halide as calculated in terms of the coupler. The emulsions thus prepared were each coated on a polyethylene double-laminated paper support in such an amount that the amount of silver and gelatin reached 0.35 g/m$^2$ and 1.50 g/m$^2$, respectively. On the emulsion layer was coated a protective layer having a gelatin content of 1.50 g/m$^2$. As gelatin hardener there was incorporated the sodium salt of 2-hydroxy-4,6-dichloro-1,3,5-triazine in each layer.

Dye stabilizer Cpd-1
2:4:4 Mixture (by weight) of:

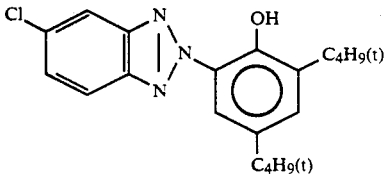

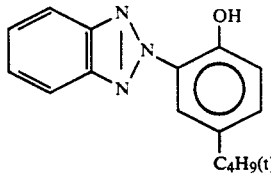

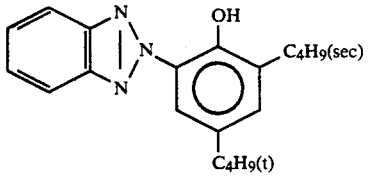

Dye stabilizer Cpd-2

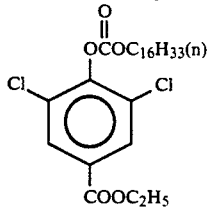

Coated Specimens 3-1 to 3-8, which comprised the cyanine dye I-15, were then exposed to light from a tungsten light source (color temperature: 2,854° K.) through a sharp cut filter SC-52 available from Fuji Photo Film Co., Ltd. (which transmits light of a wavelength longer than about 500 nm) and a continuous wedge. Coated Specimens 3-9 to 3-12, which comprised the cyanine dye I-4, were exposed to light from the tungsten light source through a sharp cut filter SC-46 (which transmits light of a wavelength longer than about 450 nm) and a continuous wedge.

The specimens thus exposed were then subjected to color development in the following steps:

| Processing step | Temperature | Time | Replenishment rate* | Tank capacity |
|---|---|---|---|---|
| Color development | 35° C. | 35 sec. | 161 ml | 17 l |
| Blix | 30–35° C. | 45 sec. | 215 ml | 17 l |
| Rinse 1 | 30–35° C. | 20 sec. | — | 10 l |
| Rinse 2 | 30–35° C. | 20 sec. | — | 10 l |
| Rinse 3 | 30–35° C. | 20 sec. | 350 ml | 10 l |
| Drying | 70–80° C. | 60 sec. | | |

(The rinse step was effected in a countercurrent process wherein the water flowed backward from Rinse 3 to Rinse 1.)
*per m$^2$ of light-sensitive material The various processing solutions had the following compositions:

COLOR DEVELOPER

| | Running Solution | Replenisher |
|---|---|---|
| Color developer | | |
| Water | 800 ml | 800 ml |
| Ethylenediamine-N,N,N-tetramethylenephosphonic acid | 1.5 g | 2.0 g |
| Triethanol amine | 8.0 g | 12.0 g |
| Sodium chloride | 1.4 g | — |
| Potassium carbonate | 25.0 g | 25.0 g |
| N-ethyl-N-(βmethanesulfonamidoethyl)-3-methyl-4-aminoaniline sulfate | 5.0 g | 7.0 g |
| N,N-bis(carboxymethyl) hydrazine | 5.5 g | 7.0 g |
| Brightening agent (WHITEX 4B, available from Sumitomo Chemical Co., Ltd.) | 1.0 g | 2.0 g |
| Water to make | 1,000 ml | 1,000 ml |
| pH (25° C.) | 10.05 | 10.45 |

| Blix solution (the running solution was used also as the replenisher) | |
|---|---|
| Water | 800 ml |
| 70% Ammonium thiosulfate | 100 ml |
| Sodium sulfite | 17 g |
| Ammonium ethylendiamine-tetraacetato ferrate | 55 g |
| Disodium ethylenediamine-tetraacetate | 5 g |
| Ammonium bromide | 40 g |
| Water to make | 1,000 ml |
| pH (25° C.) | 6.0 |

Rinse Solution (The Running Solution Was Used Also As The Replenisher)

Ion-exchanged water (calcium and magnesium concentrtion: 3 ppm or less each)

The evaluation of photographic properties was carried out as follows:

These specimens were measured for magneta color density by means of a P type densitometer available from Fuji Photo Film Co., Ltd. through a green filter to determine sensitivity and fog. The reference point at which the sensitivity is determined is the density point of "fog+1.0". The sensitivity is represented by the reciprocal of the exposure required to give the density of "fog+1.0". The values of Coated Specimens 3-1 to 3-8 are represented relative to that of Coated Specimen No. 3-1 prepared free of potassium thiocyanate and a tetrazaindene compound as 100. The values of Coated Specimens 3-9 to 3-12 are represented relative to that of Coated Specimen No. 3-9 as 100.

Figure 6:
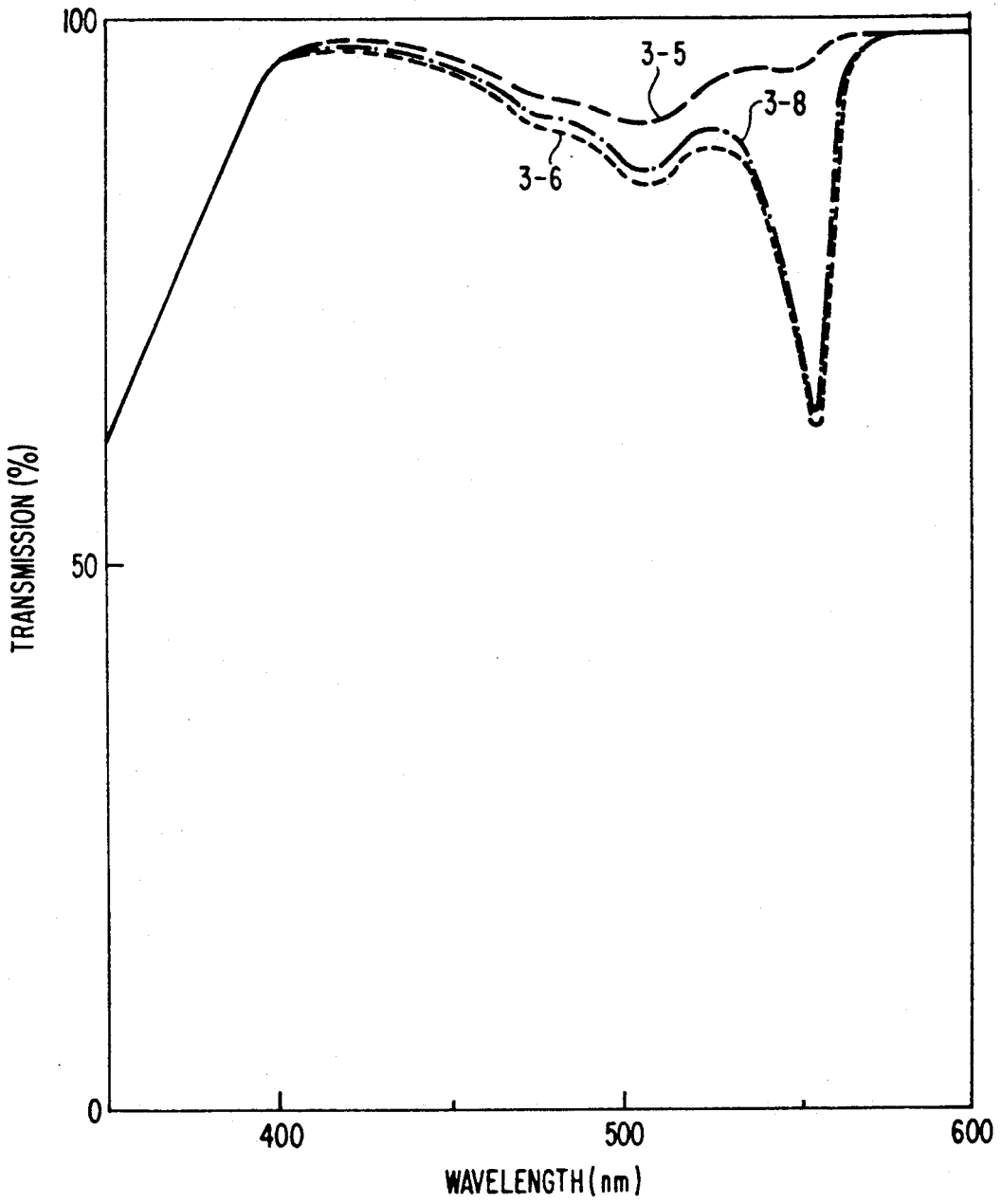
FIG. 6 is a graph illustrating the transmission absoption spectrum of Specimens 3-5 (broken line), 3-6 (dotted line) and 3-8 (chain line) of Example 3.

Further, as an example of the constitution of the present invention which enables remarkable formation of J-aggregates with a high silver chloride content tabular grain emulsion and silver chloride, the absorption spectrum of Coated Specimen Nos. 3-5, 3-6 and 3-8 are shown in FIG. 6.

TABLE 3

| Specimen No. | Emulsion No. and % silver chloride content | Added amount of KSCN × $10^{-3}$ mol/mol Ag | Kind of tetrazaindene compound and added amount thereof × $10^{-3}$ mol/mol Ag | | Relative spectral sensitivity | Remarks |
|---|---|---|---|---|---|---|
| 3-1 | (8) 80 | — | — | | 100 (reference) | Comparative |
| 3-2 | (8) 80 | 3.5 | — | | 490 | " |
| 3-3 | (8) 80 | — | II-2 | 5.0 | 204 | " |
| 3-4 | (8) 80 | 3.5 | II-2 | 5.0 | 1318 | Present Invention |
| 3-5 | (9) 100 | — | — | | 95 | Comparative |
| 3-6 | (9) 100 | 3.5 | — | | 468 | " |
| 3-7 | (9) 100 | — | II-20 | 4.5 | 178 | " |
| 3-8 | (9) 100 | 3.5 | II-20 | 4.5 | 1072 | Present Invention |
| 3-9 | (9) 100 | — | — | | 100 (reference) | Comparative |
| 3-10 | (9) 100 | 3.5 | — | | 4467 | " |
| 3-11 | (8) 100 | — | III-1 | 4.5 | 214 | " |
| 3-12 | (9) 100 | 3.5 | III-1 | 4.5 | 10470 | Present Invention |

EXAMPLE 4

Emulsion 4 as used in Example 1 (an emulsion of octahedral pure silver chloride grains) which had not yet been subjected to chemical sensitization was used in this example. To this emulsion was added the cyanine dye I-50 of the present invention in an amount of $4.25\times10^{-4}$ mol and potassium thiocyanate as set forth in Table 4 at a temperature of 70° C. After 30 minutes, the system was cooled to a temperature of 60° C. The emulsion was then ripened with sodium thiosulfate and chloroauric acid for 30 minutes to obtain optimum sensitivity. To the emulsion was then added the tetrazaindene compound II-1 as set forth in Table 4.

In the same manner as in Example 1, the emulsion was coated on a support, and a protective layer comprising gelatin as main component was then coated thereon.

These coated specimens were each exposed to light from a tungsten light source (color temperature: 2,854° K.) through a red sharp cut filter SC-72 available from Fuji Photo Film Co., Ltd. (which exhibits a transmission of about 42% at 720 nm and transmits light of a wavelength longer than about 680 nm) and a continuous wedge.

Figure 7:
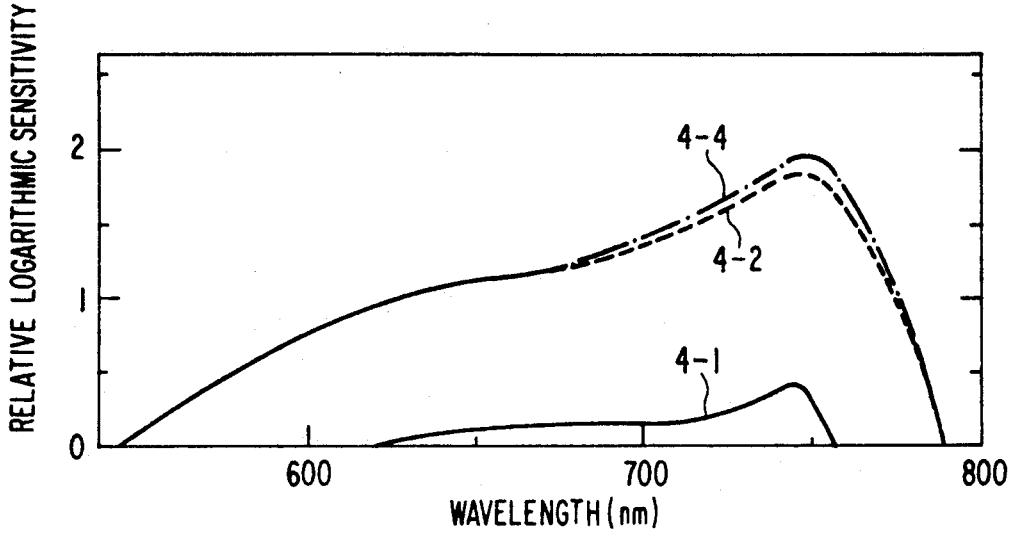
FIG. 7 is a graph illustrating the spectral sensitivity distribution spectrum of Specimens 4-1 (solid line), 4-2 (dotted line) and 4-4 (chain line) of Example 4 which gives a density of 0.3.
Figure 8:
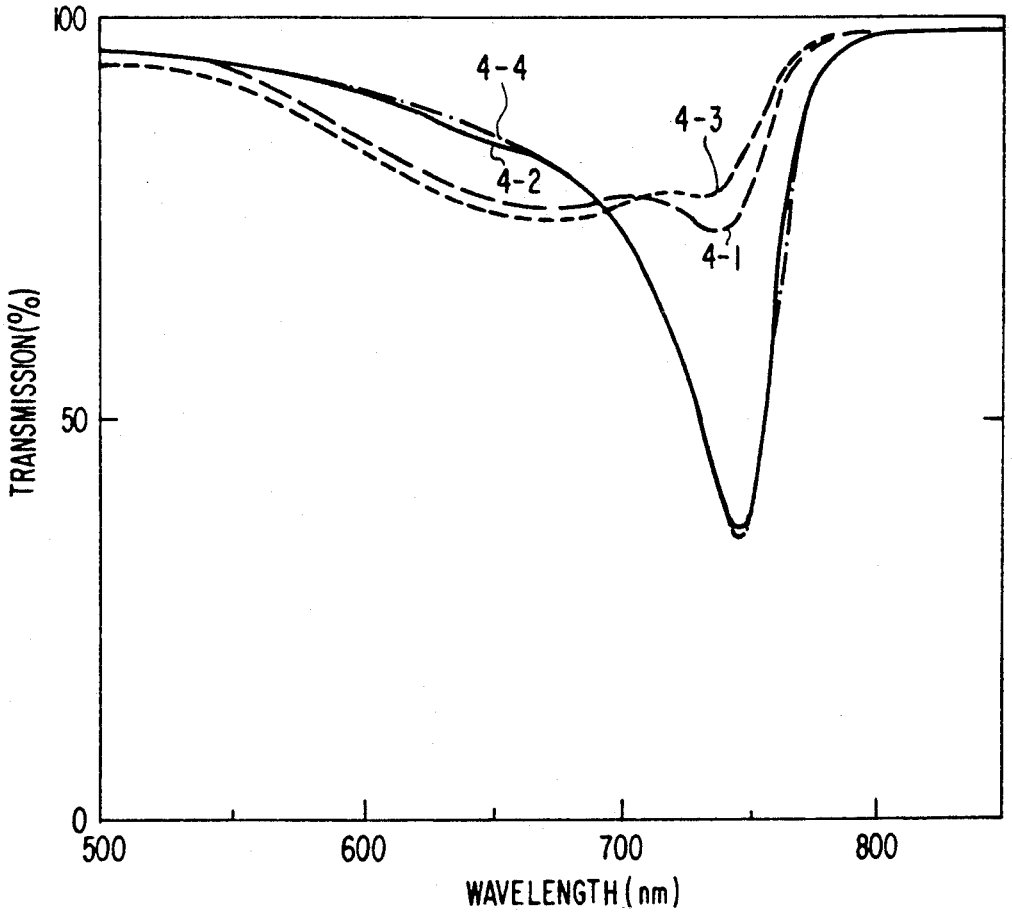
FIG. 8 is a graph illustrating the transmission absoption spectrum of Specimens 4-1 (broken line), 4-2 (solid line), 4-3 (dotted line) and 4-4 (chain line) of Example 4.

These specimens thus exposed were developed in the same manner as in Example 1. These specimens were then measured for density by means of a P type densitometer available from Fuji Photo Film Co., Ltd. to determine sensitivity with an infrared filter in the same manner as in Example 1. The results are set forth in Table 4. The spectral sensitivity distribution spectrum and absorption spectrum of these specimens are shown in FIG. 7 and FIG. 8, respectively.

TABLE 4

| Specimen No. | Added amount of KSCN × $10^{-3}$ mol/mol Ag | Added amount of Compound II-1 × $10^{-3}$ mol/mol Ag | Relative sensitivity | Remarks |
|---|---|---|---|---|
| 4-1 | — | — | 100 (reference) | Comparative |
| 4-2 | 3.0 | — | 2512 | " |
| 4-3 | — | 3.9 | 282 | " |
| 4-4 | 3.0 | 3.9 | 5754 | Present Invention |

EXAMPLE 5

A monodisperse emulsion of cubic silver chloride grains with an average side length of 0.73 μm and a standard deviation of 0.12 was prepared in the same manner as Emulsion 7 as used in Example 2 (emulsion of pure silver chloride grains). To this emulsion was added an emulsion of finely divided silver bromide grains in an amount of 0.01 mol per mol of silver chloride for ripening. The emulsion was then heated to a temperature of 70° C. To the emulsion was then added the cyanine dye I-46 of the present invention in an amount of $3.60\times10^{-4}$ mol and potassium thiocyanate as set forth in Table 5. After 30 minutes, the system was cooled to a temperature of 60° C. The emulsion was then ripened with sodium thiosulfate and chloroauric acid to obtain optimum sensitivity. To the emulsion was then added the tetrazaindene compound II-1 as set forth in Table 5.

The emulsion was coated on a support, and a protective layer comprising gelatin as a main component was then coated thereon in the same manner as in Example 1 except that the coated amount of silver was 2.65 g/m$^2$.

These coated specimens were each exposed to light from a tungsten light source (color temperature: 2,854° K.) through a red sharp cut filter SC-74 available from Fuji Photo Film Co., Ltd. (which exhibits a transmission of about 47% at 740 nm and transmits light of a wavelength longer than about 700 nm) and a continuous wedge.

Figure 9:
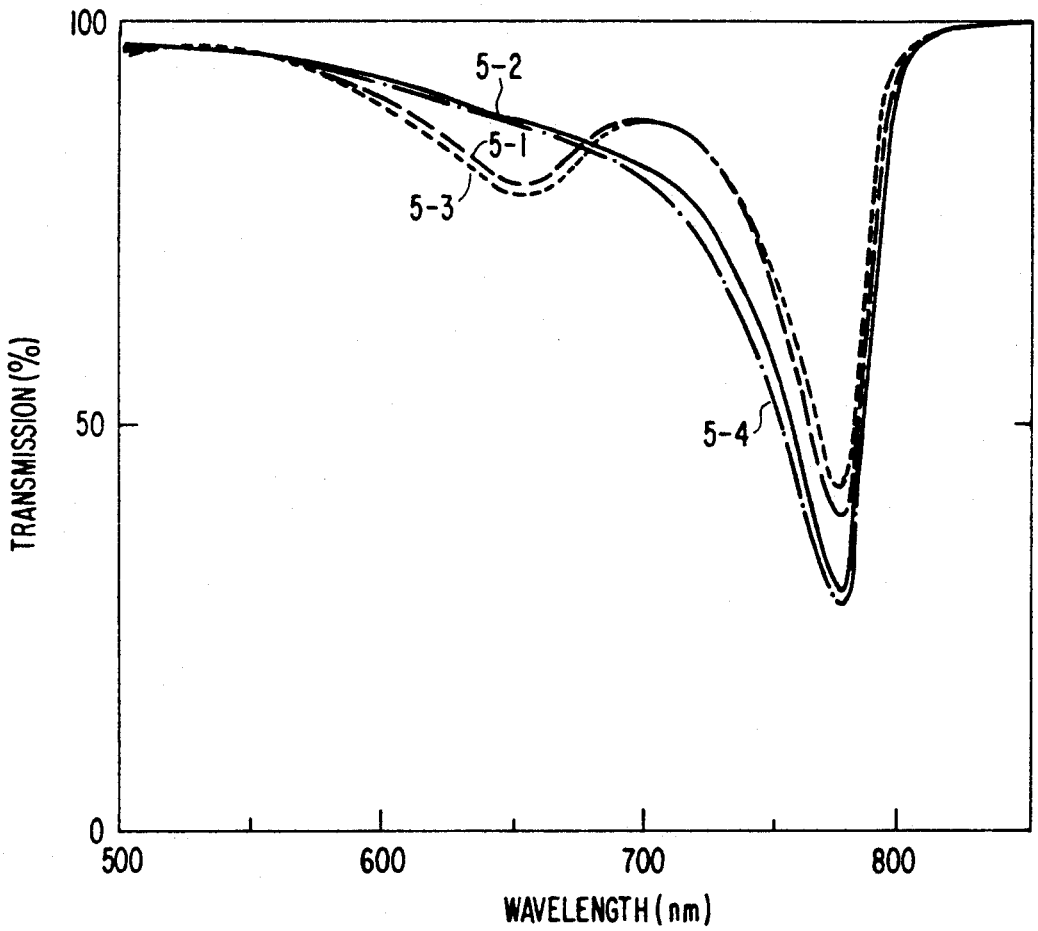
FIG. 9 is a graph illustrating the transmission absoption spectrum of Specimens 5-1 (broken line), 5-2 (solid line), 5-3 (dotted line), and 5-4 (chain line) of Example 5.

These specimens thus exposed were developed in the same manner as in Example 1. These specimens were then measured for density by means of a P type densitometer available from Fuji Photo Film Co., Ltd. to determine sensitivity with an infrared filter in the same manner as in Example 1. The results are set forth in Table 5. The absorption spectrum of these coated specimens are shown in FIG. 9.

TABLE 5

| Specimen No. | Added amount of KSCN × $10^{-3}$ mol/mol Ag | Added amount of Compound II-1 × $10^{-3}$ mol/mol Ag | Relative sensitivity | Remarks |
|---|---|---|---|---|
| 5-1 | — | — | 100 (reference) | Comparative |
| 5-2 | 1.5 | — | 112 | " |
| 5-3 | — | 3.2 | 347 | " |
| 5-4 | 1.5 | 3.2 | 468 | Present Invention |

It has been disclosed herein that when a silver halide emulsion comprising high silver chloride content grains contains at least one cyanine dye represented by the general formula (I), at least one thiocyanate compound and at least one of compound represented by the general formula (II), (III) or (IV), it provides a remarkably strong formation of J-aggregates of cyanine dye from which a high spectral sensitivity can be obtained.

As shown in FIG. 1, the use of cyanine dye alone does not provide a strong formation of J-aggregates on such a high silver chloride content emulsion. The resulting J-band absorption is weak. The use of a cyanine dye in combination with thiocyanate provides an increase in J-band absorption with a decrease in the absorption in M-band. As a result, J-band type spectral sensitization can be obtained, drastically increasing spectral sensitization in J-band as shown in Table 1. Further, as disclosed herein, the combined use of a tetrazaindene compound provides further remarkable improvements in spectral sensitivity without impairing the strengthened J-band. Such a phenomenon is not observed on emulsions comprising silver bromide as a main component. In particular, as can be seen in Specimens 1-1 to 1-4 prepared from an emulsion of octahedral silver bromochloride grains with a silver chloride content of 30 mol % as set forth in Table 1, even the use of a thiocyanate compound with a cyanine dye does not provide an increase in sensitivity, but rather provides a decrease in sensitivity. As is well known, such an emulsion of silver bromochloride grains comprising silver bromide as main component has been observed to provide a strong formation of J-band. Unlike high silver chloride content grains, such an emulsion exhibits no increase in J-band absorption, rather some decrease in J-band absorption, by the combined use of a thiocyanate compound (Specimens 1-1 and 1-2 exhibit little change in J-band absorption). Therefore, such an emulsion exhibits only an undesirable effect of reducing sensitivity due to the addition of a thiocyanate compound without increasing the percentage of light absorption. If such an emulsion of cubic silver bromochloride grains comprising silver bromide as a main component is used together with a tetrazaindene compound and a cyanine dye, it exhibits an increase in sensitivity even upon rapid development as is well known.

When only a tetrazaindene compound is incorporated in a high silver chloride content emulsion, the emulsion exhibits a remarkable increase in its inherent sensitivity. However, it has been known that when the tetrazaindene compound is incorporated in combination with a cyanine dye into the high silver chloride content emulsion, it inhibits the adsorption of the dyes and the formation of j-aggregates, causing little increase or some decrease in spectral sensitivity, as shown in Table 1. However, the combined use of a thiocyanate compound can provide an extremely high spectral sensitivity in J-band with a high silver chloride content emulsion, which has been unprecedented with a silver bromochloride emulsion comprising silver bromide as a main component.

On the other hand, the use of other azole compounds only causes a reduction in sensitivity (Specimens 1-18 and 1-20).

With the developer in Example 1, the specimens prepared from high silver chloride content emulsions of the present invention can be developed in 20 seconds while the specimens prepared from silver bromochloride emulsions with a silver chloride content of 30 mol % cannot be yet developed in 20 seconds. The latter specimens can be developed in 2 minutes. The resulting relative sensitivity is about 1.4 times that obtained by 30-second development as set forth in Table 1. The former specimens of the present invention can be developed in a very short period of time. The resulting relative sensitivity is about the same as or higher than that of the latter specimens.

Table 2 shows the results obtained with cubic grain emulsions. Cubic grain emulsions exhibit a formation of J-aggregates which is weak but stronger than that of octahedral grain emulsions even with high silver chloride content emulsions and show considerable J-band absorption as shown in FIG. 5. Therefore, unlike octahedral grain emulsions, cubic grain emulsions exhibit a reduction in sensitivity in J-band (sensitivity with Filter 2) even with the combined use of a cyanine dye of the present invention and a thiocyanate compound as in the case where a silver bromochloride emulsion comprising silver bromide as a main component (Specimen 2-2). However, the additional combination of a tetrazaindene compound provides a very large increase in sensitivity as compared with that obtained with a silver bromochloride emulsion comprising silver bromide as a main component (Specimens 2-6 and 2-9), which has been unprecedented with the combined use of other azole compounds. Further, in FIGS. 5 and 6, cubic grain emulsions show a small change in the absorption in the vicinity of 600 nm, which corresponds to M-band range. However, the high silver chloride content emulsions exhibit a higher sensitivity in the vicinity of 600 nm with a cyanine dye alone than silver bromochloride emulsions comprising silver bromide as a main component. On the other hand, the specimens according to the present invention (Specimens 2-6 and 2-9) exhibit a lower sensitvity in the vicinity of 600 nm than Specimen 2-3 prepared from a silver bromochloride emulsion comprising silver bromide as main component, realizing a spectral sensitivity distribution with a high J-band sensitivity/M-band sensitivity ratio. Such desirable results in development will be better understood from the spectral sensitivity distribution spectrum shown in FIGS. 2 and 3. The technique by which high sensitivity can be provided only in the desired wavelength range while keeping the sensitivity in other wavelength ranges as low as possible is essential to the enhancement of safety to safelight or the inhibition of color stain in designing color multi-layer light-sensitive materials to provide a sharp color photograph.

As shown in Tables 3, 4 and 5, and FIGS. 5 to 9, the constitution of the present invention with a high silver chloride content emulsion can similarly provide a high J-band sensitization.

Further, although it is extremely difficult for a high silver chloride content emulsion having 111 plane to provide J-band sensitization with a cyanine dye, the constitution of the present invention provides an easy realization of high J-band sensitization. Dicarbocyanine dyes have heretofore been known to exhibit M-band type sensitization. However, it has not been well known that discarbocyanine dyes provide J-band sensitization, except for one report that some dicarbocyanine dyes exhibit J-band sensitization on a silver bromoiodide emulsion.

One of the inventors disclosed a technique by which some dicarbocyanine dyes contained in the cyanine dye represented by general formula (I) can realize J-band sensitization even on various silver halide emulsions such as silver bromoiodide, silver bromide, silver chloride and silver bromochloride. The inventors found the technique of the present invention by which even higher sensitivity can be provided only in J-band range up to infrared range on the most difficult high silver chloride content emulsions.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one silver halide emulsion layer on a support, wherein said emulsion layer comprising (i) silver halide grains which are at least 80 mol % silver chloride and for which 50% or more of the surface is 111 plane, (ii) at least one thiocyanate, (iii) at least one cyanine dye represented by general formula (I) and (iv) at least one compound represented by general formula (II) or (III):

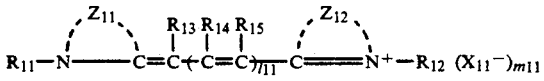

(I)

wherein $Z_{11}$ and $Z_{12}$ may be the same or different and each represents an atomic group for forming a naphthaothiazole nucleus, a naphthoselenazole nucleus, a quinoline nucleus, a benzothiazole nucleus, a benzoselenazole nucleus, a benzoxazole nucleus, a naphthoxazole nucleus or a benzimidazole nucleus, with the provisos that when $Z_{11}$ and $Z_{12}$ represent an atomic group for forming a heterocyclic nucleus other than said benzimidazole nucleus that the heterocyclic nucleus may be substituted with a lower alkyl group, a lower alkoxy group, a hydroxyl group, a halogen atom, an aryl group, an acylamino group, a carboxy group or a lower alkoxy carbonyl group, and that when $Z_{11}$ and $Z_{12}$ represent an atomic group for forming said benzimidazole nucleus that the heterocyclic nucleus may be substituted with a halogen atom, a cyano group, a carboxy group, a lower alkoxy carbonyl group or a perfluoroalkyl group; $R_{11}$ and $R_{12}$ may be the same or different and each represents a alkyl group which may be substituted with a sulfo group, a carboxy group, a hydroxyl group, an aryloxy group, an acyl group, a carbamoyl group or an acylamino group; $R_{15}$ represents a hydrogen atom or $R_{15}$ may be connected to $R_{12}$ to form a 5- or 6-membered ring; $R_{13}$ represents a hydrogen atom or may be connected to $R_{11}$ to form a 5- or 6-membered ring; $R_{14}$ represents a hydrogen atom or a substituted or unsubstituted lower alkyl group; $X_{11}$ represents an ion required to neutralize the electrical charge of the compound of formula (I); $l_{11}$ represents an integer 0, 1 or 2, with the proviso that when $l_{11}$ is 2, $R_{15}$ on the third carbon atom of the methine chain may represent a substituted or unsubstituted lower alkyl group or two $R_{14}$ groups may be connected to each other to form a 6-membered carbon ring; and $m_{11}$ represents an integer 0 or 1, with the proviso that when the compound of formula (I) is an intramolecular salt, $m_{11}$ is 0;

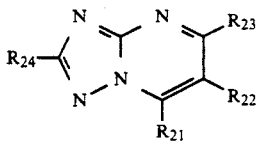

(II)

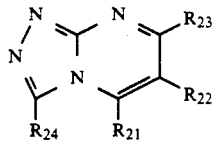

(III)

wherein $R_{21}$, $R_{22}$, $R_{23}$ and $R_{24}$ may be the same or different and each represents a hydrogen atom, an alkyl group which may be substituted, an aryl group which may be substituted, an amino group which may be substituted, a hydroxyl group, an alkoxy group, an alkylthio group, a carbamoyl group which may be substituted, a halogen atom, a cyano group, a carboxyl group, an alkoxycarbonyl group or a heterocyclic group; and $R_{21}$ and $R_{22}$ or $R_{22}$ and $R_{23}$ may be connected to each other to form a 5- or 6-membered ring, with the proviso that at least one of $R_{21}$ and $R_{23}$ represents a hydroxyl group.

2. A silver halide photographic material as claimed in claim 1, wherein said silver halide grains are formed in the presence of a silver halide growth modifier comprising a bispyridinium salt compound.

3. A silver halide photographic material as claimed in claim 1, wherein said emulsion contains a compound represented by general formula (II).

4. A silver halide photographic material as claimed in claim 1, wherein said emulsion contains a compound represented by general formula (III).

* * * * *